US011517169B2

(12) United States Patent
Khubani

(10) Patent No.: US 11,517,169 B2
(45) Date of Patent: Dec. 6, 2022

(54) SURFACE CLEANING DEVICE

(71) Applicant: Ontel Products Corporation, Fairfield, NJ (US)

(72) Inventor: Ashok Khubani, Palm Beach Gardens, FL (US)

(73) Assignee: ONTEL PRODUCTS CORPORATION, Fairfield, NJ (US)

( * ) Notice: Subject to any disclaimer, the term of this patent is extended or adjusted under 35 U.S.C. 154(b) by 310 days.

(21) Appl. No.: 16/905,063

(22) Filed: Jun. 18, 2020

(65) Prior Publication Data

US 2021/0000316 A1 Jan. 7, 2021

Related U.S. Application Data

(60) Provisional application No. 62/869,088, filed on Jul. 1, 2019.

(51) Int. Cl.

| | |
|---|---|
| ***A47L 11/26*** | (2006.01) |
| ***A47L 11/22*** | (2006.01) |
| ***A47L 11/40*** | (2006.01) |

(52) U.S. Cl.

CPC ..... *A47L 11/26* (2013.01); *A47L 11/22* (2013.01); *A47L 11/4002* (2013.01); *A47L 11/4041* (2013.01); *A47L 11/4075* (2013.01); *A47L 11/4083* (2013.01); *A47L 11/4088* (2013.01)

(58) Field of Classification Search

CPC ..... A47L 11/26; A47L 11/22; A47L 11/4002; A47L 11/4041; A47L 11/4075; A47L 11/4083; A47L 11/4088; A47L 11/085; A47L 11/185; A47L 11/4036; A47L 13/44; A47L 13/22

See application file for complete search history.

(56) References Cited

U.S. PATENT DOCUMENTS

| | | | |
|---|---|---|---|
| 5,165,134 | A | 11/1992 | Moore |
| 5,735,959 | A | 4/1998 | Kubo et al. |
| 6,584,990 | B2 | 7/2003 | Shaw |
| 7,013,528 | B2 | 3/2006 | Parker et al. |
| 7,048,804 | B2 | 5/2006 | Kisela et al. |
| 7,137,169 | B2 | 11/2006 | Murphy et al. |
| 7,152,267 | B2 | 12/2006 | Kaleta |

(Continued)

FOREIGN PATENT DOCUMENTS

| | | | |
|---|---|---|---|
| CN | 105433871 | * | 3/2016 |
| CN | 209220145 | U | 8/2019 |

(Continued)

OTHER PUBLICATIONS

30 Minute Lithium Powered Floor Sweeper; Black & Decker; 7 pages; Date accessed: Jan. 3, 2019.

(Continued)

*Primary Examiner* — David Redding

(74) *Attorney, Agent, or Firm* — Dickinson Wright PLLC

(57) ABSTRACT

A surface cleaning device comprises a cleaning head having a housing, a fluid tank configured to store fluid and be in fluid communication with the cleaning head, a cleaning pad coupled to the cleaning head and configured to remove debris from a surface, and a plurality of nozzles distributed along the cleaning pad, wherein the fluid tank is configured to release at least some of the fluid such that the released fluid flows through the plurality of nozzles onto the cleaning pad.

19 Claims, 17 Drawing Sheets

(56) References Cited

U.S. PATENT DOCUMENTS

| | | | | |
|---|---|---|---|---|
| 7,340,795 | B2 | 3/2008 | Kaleta | |
| 7,591,039 | B2 | 9/2009 | Kaleta et al. | |
| 8,186,898 | B2 * | 5/2012 | Bradbury | A47L 13/22 15/228 |
| D693,079 | S | 11/2013 | Nordvik | |
| 9,655,486 | B2 | 5/2017 | Xu et al. | |
| 9,974,423 | B2 | 5/2018 | Policicchio et al. | |
| 2007/0209138 | A1 | 9/2007 | Tran et al. | |
| 2008/0066789 | A1 * | 3/2008 | Rosenzweig | A47L 13/256 417/101 |
| 2013/0333129 | A1 * | 12/2013 | Bradbury | A47L 9/0422 15/210.1 |
| 2015/0033483 | A1 * | 2/2015 | Milanese | A47L 13/12 15/104.94 |
| 2016/0287046 | A1 * | 10/2016 | Schmitt | D04H 1/43838 |
| 2016/0374532 | A1 | 12/2016 | Patterson et al. | |

FOREIGN PATENT DOCUMENTS

| | | | |
|---|---|---|---|
| GB | 2078496 | * | 1/1982 |
| WO | WO2012138204 | * | 10/2012 |

OTHER PUBLICATIONS

60 Minute Lithium Powered Floor Sweeper; Black & Decker; 4 pages; Date accessed: Jan. 3, 2019.

Search Report regarding corresponding EP App. No. 20184859.5; dated Dec. 4, 2020.

* cited by examiner

SURFACE CLEANING DEVICE

CROSS-REFERENCE TO RELATED APPLICATIONS

This application claims priority to U.S. Provisional Patent Application Ser. No. 62/869,088, filed on Jul. 1, 2019, the entire disclosure of which is incorporated herein by reference.

TECHNICAL FIELD

This disclosure relates generally to a surface cleaning device for cleaning a surface.

BACKGROUND

A surface cleaning device, such as a broom, a sweeper, or a vacuum cleaner, can be used to clean a variety of surfaces, such as wood, tile, and carpeted floors. Surface cleaning devices can collect large debris, such as crumbs, dirt, and pebbles, from floors and other surfaces using suction and rotatable roller brushes. Surface cleaning devices may have too much or too little suction for a specific type of surface, resulting in inadequate cleaning. Debris, such as long animal fur, floss, string, and hair may become tangled in the roller brushes, which can prevent the roller brushes from rotating properly thereby decreasing the effectiveness of the surface cleaning device. It can be difficult to remove all debris from the roller brushes and such removal may not be possible or may result in damage to the surface cleaning device. Surface cleaning devices may have wheels to allow for movement over a surface. Wheels may restrict movement of the surface cleaning device, requiring more force to move the surface cleaning device thereby preventing full rotation of the surface cleaning device. This makes it particularly hard to clean in hard-to-reach surface areas. In addition, small debris, including dust-sized particles may remain on the surface thereby requiring additional cleaning.

A surface cleaning device, such as a mop or a cleaning cloth, can be used to clean small debris, including moisture, from a variety of hard surfaces, such as wood and tile floors. Instead of using a mop and bucket for cleaning the surface, mops can include a spray nozzle located on a front portion of the mop to spray cleaning fluid to the surface in front of the mop. The mop can then be pushed over the cleaning fluid to clean the surface.

Some surface cleaning devices include a combination of a sweeper and a mop, but they may require a two-step cleaning process. More specifically, the larger debris should be removed from the surface before the spray nozzle is activated to mop the floor. If larger debris is wet, neither the sweeper nor the mop features of the surface cleaning device can remove such debris from the surface. Therefore, the surface may need to be swept before being mopped. This process can be time consuming.

SUMMARY

This section provides a general summary of the present disclosure and is not a comprehensive disclosure of its full scope or all of its features, aspects, and objectives.

Disclosed herein are exemplary implementations of a surface cleaning device. In some aspects, a surface cleaning device comprises a cleaning head having a housing; a fluid tank configured to store fluid and be in fluid communication with the cleaning head; a cleaning pad coupled to the cleaning head and configured to remove debris from a surface; and a plurality of nozzles distributed along the cleaning pad, wherein the fluid tank is configured to release at least some of the fluid such that the released fluid flows through the plurality of nozzles onto the cleaning pad.

In other aspects, a surface cleaning device comprises a cleaning head; a fluid tank configured to store fluid and be in fluid communication with the cleaning head; a cleaning pad coupled to the cleaning head and configured to remove debris from a surface, wherein the cleaning pad is formed from wicking material and non-wicking materials; and a plurality of nozzles distributed along the cleaning pad, wherein the fluid tank is configured to release at least some of the fluid such that the released fluid flows through the plurality of nozzles onto the cleaning pad.

In yet other aspects, a surface cleaning device comprises a cleaning head coupled to a housing, wherein the housing defines an inlet opening; a base coupled to the cleaning head and comprising a pair of tapered front portions; a pair of flaps coupled to the pair of tapered front portions and configured to direct debris toward the inlet opening; a debris container disposed within the housing; a sweeper assembly disposed within the housing adjacent to the debris container and configured to sweep at least some of the debris from the surface into the debris container; a cleaning pad coupled to the base and configured to remove at least some of the debris from the surface; a fluid tank configured to store fluid and be in fluid communication with the cleaning head; and a plurality of nozzles distributed along the cleaning pad, wherein the fluid tank is configured to release at least some of the fluid such that the released fluid flows through the plurality of nozzles onto the cleaning pad.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The terminology used herein is for the purpose of describing particular example embodiments only, and is not intended to be limiting. As used herein, the singular forms "a," "an," and "the" may be intended to include the plural forms as well, unless the context clearly indicates otherwise.

The terms first, second, third, etc. may be used herein to describe various elements, components, regions, layers and/or sections; however, these elements, components, regions, layers and/or sections should not be limited by these terms. These terms may be only used to distinguish one element, component, region, layer, or section from another region, layer, or section. Terms such as "first," "second," and other numerical terms, when used herein, do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," "top," "bottom," "right," "left," and the like, may be used herein. These spatially relative terms can be used for ease of description to describe one element's or feature's relationship to another element(s) or feature(s) as illustrated in the figures. The spatially relative terms may also be intended to encompass different orientations of the device in use, or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptions used herein interpreted accordingly.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The following description is merely exemplary in nature and is not intended to limit the disclosure in its application or uses. For purposes of clarity, the same reference numbers are used in the description and drawings to identify similar elements.

Figure 1:
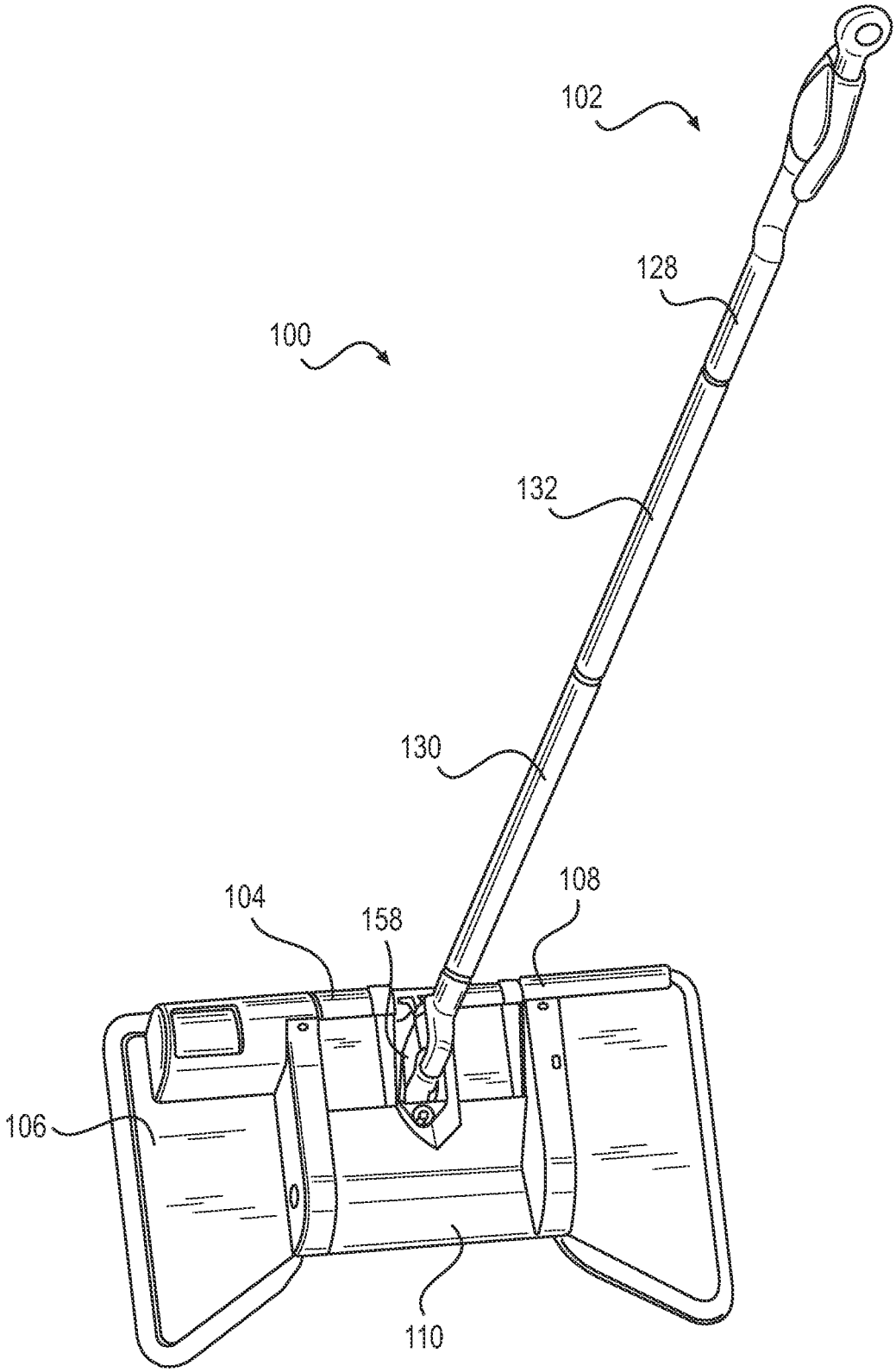
FIG. 1 is a perspective view of one embodiment of a surface cleaning device in accordance with aspects of the present disclosure.
Figure 2:
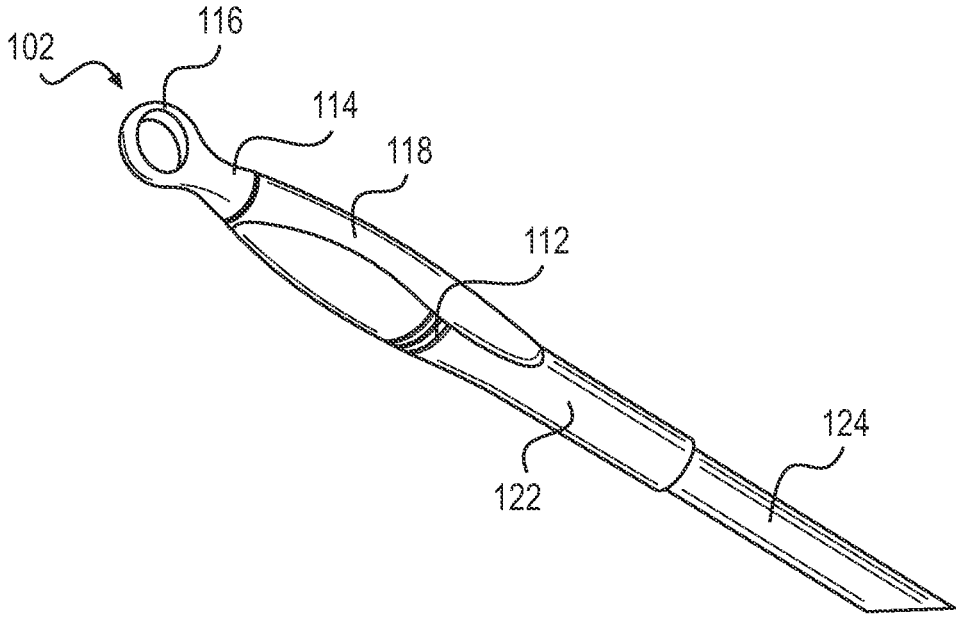
FIG. 2 is a perspective view of a handle of the surface cleaning device in accordance with aspects of the present disclosure.
Figure 3:
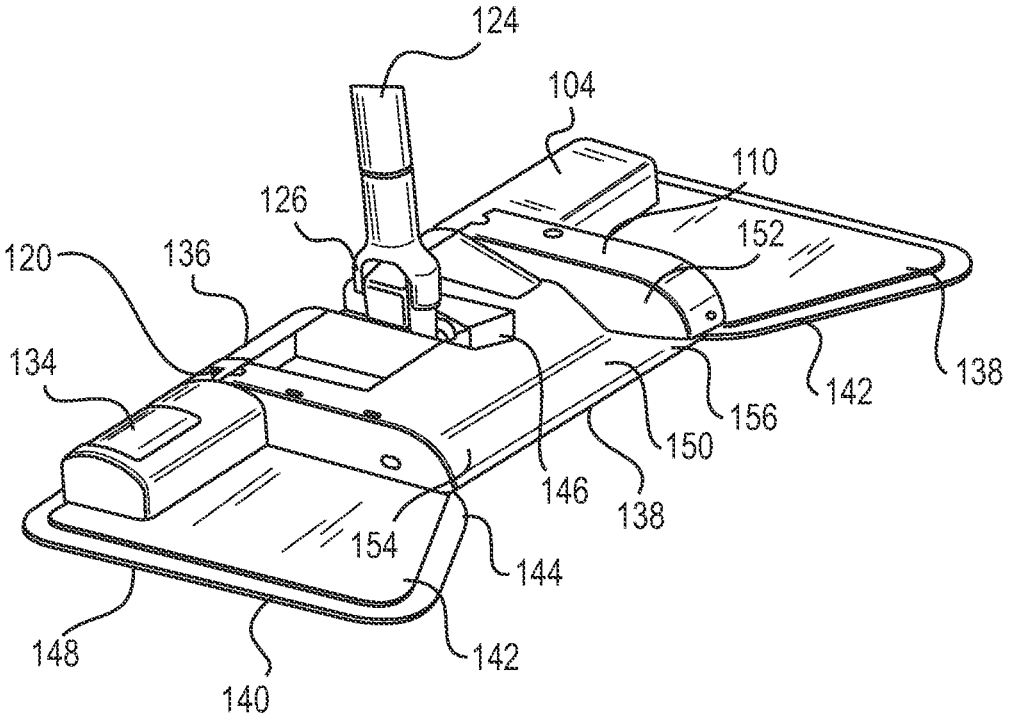
FIG. 3 is a perspective view of a cleaning head of the surface cleaning device in accordance with aspects of the present disclosure.
Figure 4:
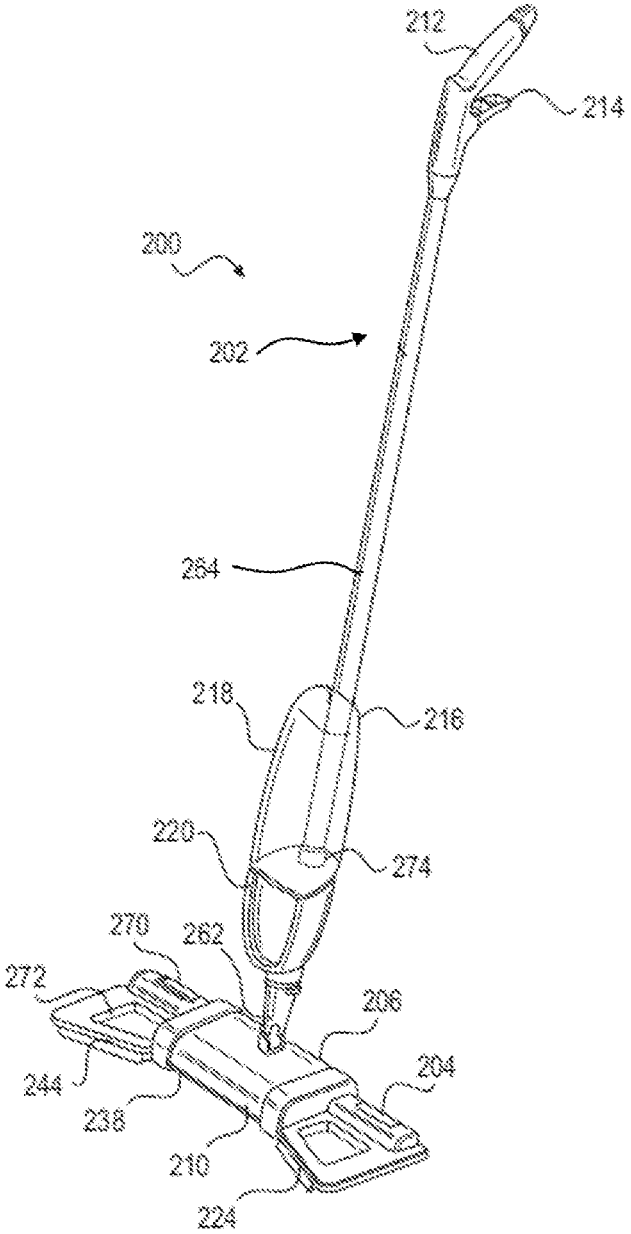
FIG. 4 is a perspective view of one embodiment of a surface cleaning device in accordance with aspects of the present disclosure.
Figure 5:
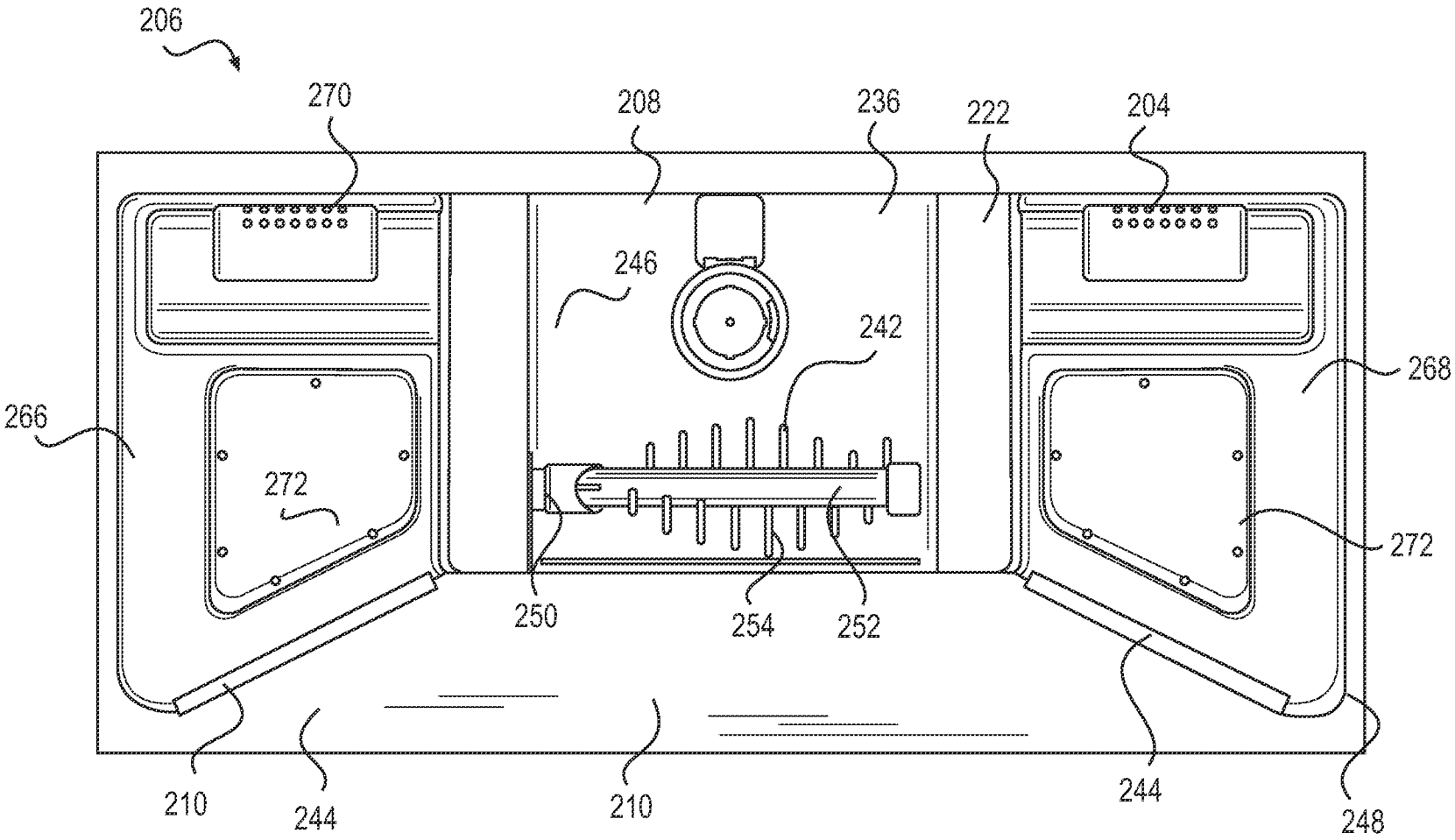
FIG. 5 is a perspective view of a handle of the surface cleaning device in accordance with aspects of the present disclosure.
Figure 6:
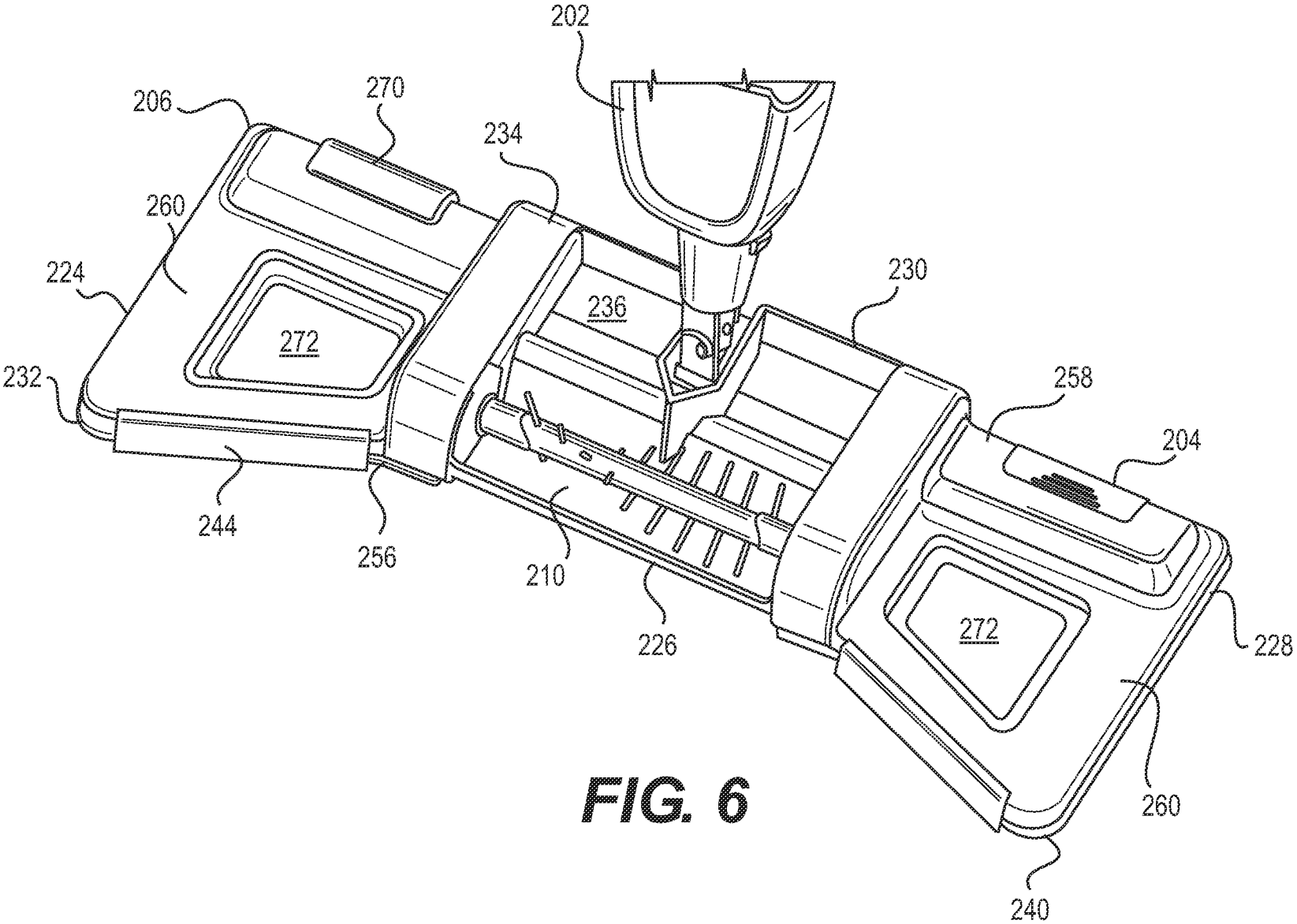
FIG. 6 is a perspective view of a cleaning head of the surface cleaning device in accordance with aspects of the present disclosure.

FIGS. 1-3 illustrate an exemplary surface cleaning device 100 in accordance with aspects of the present disclosure. The surface cleaning device 100 can be configured to remove debris by sweeping and by dry mopping in one step. The surface cleaning device 100 can include a handle assembly 102, a battery assembly 104, a cleaning head 106, a motor assembly 108, and a sweeper assembly 110.

The handle assembly 102 can include a handle 112. FIG. 2 illustrates an exemplary handle 112 of the surface cleaning device 100. The handle 112 can be formed at a top end 114 of the handle assembly 102. The handle 112 can be formed from plastic, rubber, or any other desired material. The handle 112 can be oblong in shape or any other desired shape. The handle 112 can have ergonomic features for the comfort of a user.

The handle 112 can include a hanger 116. The hanger 116 can be positioned at the top end 114. The hanger 116 can be a ring or any other desired shape. The hanger 116 can rotate. For example, the hanger 116 can rotate 360 degrees or any other desired degrees about the handle 112. The hanger 116 can be used to hang the surface cleaning device 100, for example, on a hook, for storage or any other desired purpose. The hanger 116 can rotate to provide more convenient and efficient storage of the surface cleaning device 100.

The handle assembly 102 can have a grip 118. The grip 118 can be coupled to the handle 112. The grip 118 can be located on a rear portion 122 of the handle assembly 102 or any other desired location. The grip 118 can be formed from the handle 112. The grip 118 can be formed from plastic, rubber, or any other desired material. The grip 118 can be smooth, have groves, or any other desired surface.

The handle assembly 102 can include a pole 124. The pole 124 can be coupled to a handle 112. The handle 112 can be connected to the top end 114 of the pole 124. The pole 124 can be telescopingly received by the handle 112, or any other desired attachment. The pole 124 can be formed as an elongated arm having a tubular shape and extending between a top end 114 and a bottom end 126. The pole 124 can include one or more segments. For example, the pole 124 can include a first segment 128 proximal to the top end 114 of the surface cleaning device 100 and a second segment 130 proximal to the bottom end 126 of the surface cleaning device 100. The first segment 128 can be telescopingly received by the second segment 130. The pole 124 can include additional segments 132 positioned between the first and second segments 128, 130, or any other desired position. The additional segments 132 can be telescopingly received by the first segment 128, the second segment 130, other additional segments 132, or any other desired device.

FIG. 3 illustrates an exemplary cleaning head 106, which can include the battery assembly 104 of the surface cleaning device 100. The battery assembly 104 can be coupled to the handle assembly 102, the pole 124, or any other desired location. The battery assembly 104 can include a battery housing. The battery housing can be formed from plastic, metal, or any other desired material. The battery housing can be opened to access at least one battery. The at least one battery can be positioned in the battery housing. The at least one battery can be electrically connected to a motor for providing power to the motor. The battery can be electrically connected to the motor and to the switch 134 to allow a user to turn the motor ON and OFF. The switch 134 can be coupled to the cleaning head 106. The battery can also be configured to change the speed of the motor. The battery housing can be configured for wires to travel though for connection with the battery. The battery can be any desired energy source, such as a re-chargeable lithium ion battery, nickel metal hydride (NiMH) battery, or any other desired power source.

The cleaning head 106 can be a generally bow-tie shape, rectangular, or any other desired shape. A mounting mechanism 158, such as a joint, universal joint, or any other desired mounting mechanism can be used to couple the cleaning head 106 to the handle assembly 102. The mounting mechanism 158 can be used to couple the cleaning head 106 to the bottom end 126 of the handle assembly 102, such as coupling to pole 124. The mounting mechanism 158, such as universal joint, can be configured to allow the pole 124 to pivot 360 degrees about the universal joint.

The cleaning head 106 can include a base coupled to the cleaning head. The base 140 can be planar. The base 140 can include a top surface and a bottom surface. The base 140 can include a front side, a rear side, and a pair of lateral sides. The front side can include a pair of tapered front portions. The pair of tapered front portions can extend from the lateral sides inwardly toward the housing. The base 140 can be formed in a generally bow-tie shape.

A cleaning pad 148 can be coupled to the cleaning head 106. The cleaning pad 148 can be configured to fit over side and rear portions of the cleaning head 106. The cleaning pad 148 can further be coupled to the base 140. The cleaning pad 148 can overlap portions of the base 140. For example, the cleaning pad can overlap rear and lateral side portions of the base 140. The cleaning pad 148 can be removably coupled to the bottom portion, or surface, of the cleaning head 106 or base 140 using Velcro®, adhesion, snaps, clips, or any other attachment means. The cleaning pad 148 can be a reusable cleaning pad and formed from material that can be washed or otherwise cleaned. The cleaning pad 148 can be a disposable cleaning pad. Thus, when the cleaning pad 148 is dirty, the cleaning pad 148 can be cleaned or replaced. The cleaning pad 148 can be a shape generally similar to the shape of the base 140. The cleaning pad 148 can be formed in a generally bow-tie shape. The cleaning pad 148 can be formed from cloth, microfiber, or any other desired material.

The pair of tapered front portions can be coupled to a pair of flaps. The pair of flaps can be configured to direct debris toward the inlet opening. The pair of flaps can be permanently attached to the pair of tapered front portions. The pair of flaps can be removably attached to the pair of tapered front portions. The pair of flaps can be formed from flexible material. For example, the pair of flaps can be formed from a hard flexible plastic material, rubber, or any other desired material.

The cleaning head 106 can include a switch 134, pedal, button, or any other desired device to activate or deactivate the surface cleaning device. The switch 134 can be configured to depress or otherwise move to activate or deactivate the surface cleaning device. The switch 134 can be coupled to a top portion of the cleaning head 106, or any other desired location. The switch 134 can be in communication with the battery assembly 104. The switch 134 can be in communication with the motor assembly 108. The switch 134 can be coupled to a motor, wherein the switch 134 can be configured to control a speed of the motor. For example, the speed of the motor can include at least one of a first speed and a second speed. The first speed can be a slow speed and the second speed can be a speed faster than the first speed. The first speed can be a fast speed and the second speed can be a speed slower than the first speed. The switch 134 can be configured activate or deactivate the motor (i.e., turn the motor ON or OFF).

The cleaning head 106 can include a housing 136. The housing 136 can be coupled to the cleaning head 106. The housing 136 can be located over the top portion of the cleaning head 106. The housing 136 can be located between the pair of tapered front portions of the cleaning head 106. The housing 136 can be a generally rectangular shape, square shape, or any other desired shape. The housing 136 can have a front portion, a rear portion, lateral side portions expending between the front and rear portions. The housing 136 can have a top side and a bottom side.

The housing 136 can define at least one inlet opening 138. The inlet opening 138 can be defined between the front portion of the cleaning head 106 and the surface. The inlet opening 138 can be configured to allow air and debris to enter under the housing 136 and into the cleaning head 106.

The sweeper assembly 110 can be coupled to the cleaning head 106. The sweeper assembly 110 can be coupled to a top portion of the housing 136. The sweeper assembly 110 can include a brush chamber 156. The brush camber 156 can be defined between the front portion of the housing 136 and a debris container 146.

The sweeper assembly 110 can include one or more brush chambers 156 disposed within the housing 136. The suction can pull debris, including smaller debris particles, into the surface cleaning device 100. The brush chamber 156 can be located around an inner front periphery of the housing 136. The brush chambers 156 can be defined between the housing 136 and the debris container 146. The housing 136 is configured to allow air to flow through the inlet opening and the brush chamber 156 to create suction with the surface.

The sweeper assembly 110 can include one or more brushes 150. The brush 150 can be disposed within the brush chamber 156. Air and debris can flow through the inlet opening and the brush chamber 156 to create a suction with a surface, such as a floor, wall, carpet, or any other desired surface. The housing, in combination with the brush 150, the brush chamber 156, and internal components of the cleaning head 106 positioned within the housing 136, can be configured to create airflow to vacuum debris into the cleaning head 106.

The brush 150 can include a roller. The roller can be rotatably coupled to the sweeper assembly 110. The roller 152 can rotate about an axis. The roller 152 can be formed as a bar or rod of plastic, metal, wood, or any other desired material or shape.

The brush 150 can include a plurality of bristles 154. The bristles 154 can be formed from a rough material, such as Palmyra; plastic, such as polypropylene and nylon; stiff fibers; a soft material, such as fibers, natural plant-based material, soft plastic; any other desirable material; or combination thereof. The bristles 154 may be cut flat, shaped at an angle, coiled, flagged, unflagged, any other desired shape, or combination thereof. The bristles 154 may be configured to sweep debris from a flat surface, such as tile and wood flooring; a carpet, including a plush carpet; a rough surface, such as concrete floors, asphalt, and walkways, any other desired surface, or combination thereof. The plurality of bristles 154 can extend outwardly from the roller 152. The bristles 154 can be coupled to, such as being embedded into, the roller 152. The brush 150, including the roller 152 can be configured to sweep the debris into the debris container 146. The roller 152 can be formed as a bar or rod of plastic, metal, wood, or any other desired material or shape.

The sweeper assembly 110 can include the debris container 146. The debris container 146 can be coupled to the cleaning head 106, including to the top surface of the cleaning head 106, or any other desired location. The debris container 146 can be disposed within the housing 136. The debris container 146 can include a housing 136 having a front side, a rear side, a pair of lateral sides, and a bottom side and defining a compartment. The debris container 146 can be rectangular or any other desired shape. The compartment can define an inlet opening configured to collect debris. The bottom side can be angled to coordinate with movement of the bristles. The debris can shoot up the bottom side and into the debris container 146. The debris can be stored within the debris container 146.

The debris container 146 can be magnetically coupled to the cleaning head 106. The debris container 146 can be magnetically coupled to the housing 136. A first magnet can be coupled to an underside portion of the housing 136, or any other desired location. A second magnet can be coupled to a top portion or any other desired location of the debris container 146. The debris container can be formed from a magnetic material or any other desired material. The debris container 146 can be removed from the cleaning head 106 for removing any collected debris from the debris container 146. When the user is finished emptying the debris container 146, the user can position the debris container 146 back into the housing 136. The debris container 146 can have other removal and insertion mechanism, such as sliders, clips, or another desired mechanism.

The motor assembly 108 can include a motor housing 120. The motor housing 120 can coupled to the housing 136, disposed within the housing 136, or any other desired location. A motor can be positioned in the motor housing 120. The motor can include an output shaft. The motor can include a first pulley secured to the output shaft of the motor. The motor can include a second pulley secured to the roller 152 in alignment with the first pulley. The motor can include a belt. The belt can be disposed about the first and second pulleys for providing rotational movement of the roller 152 in response to rotation of the motor. The motor can be coupled to the cleaning head 106 and configured to rotate the brush 150. The motor can be configured to rotate a plurality of brushes 150. The motor can rotate the brushes 150 such that the bristles 154 move in an outward to inward direction toward the debris container 146. The brush 150 or plurality of brushes 150 can move debris toward and into the debris container 146.

Wiring can be disposed within the surface cleaning device 100 to electrically couple at least the switch 134, the battery, and the motor. The wiring can be disposed in the cleaning head 106 and the motor assembly 108. The wiring can couple the battery assembly 104, including the battery, to the motor and the switch 134.

In one exemplary embodiment, the surface cleaning device 100 for removing debris from a surface can include the cleaning head 106. The housing 136 can be coupled to the cleaning head 106 and defining an inlet opening 138. The base 140 can be coupled to the cleaning head 106 and comprise a pair of tapered front portions 142. The pair of flaps 144 can be coupled to the pair of tapered front portions 142 and configured to direct debris toward the inlet opening 138. For example, the pair for flaps 144 can be attached to the base 140 and formed from a flexible material to move debris toward the inlet opening 138. The debris container can be disposed within the housing 136. The sweeper assembly 110 can be disposed within the housing 136 adjacent to the debris container 146 and configured to sweep the debris from the surface into the debris container 146. For example, the sweeper assembly 110 can include a roller 152 rotatably coupled to the sweeper assembly 110 and include the plurality of bristles 154 extending outwardly from the roller 152. The roller 152 can be configured to sweep the debris into the debris container 146. The cleaning pad 148 can be coupled to the base 140 and configured to remove at least some of the debris from the surface. For example, after the debris, such as large, dry, debris, is swept into the sweeper assembly 110 and stored in the debris container 146, at least some of the debris, such as small particles of debris, can be removed from the surface by the cleaning pad 148. In other words, the surface cleaning device 100 can be configured as a dry mop with a sweeper within the surface cleaning device.

The surface cleaning device can include additional and/or fewer components and is not limited to those illustrated in FIGS. 1-3.

FIGS. 4-7 illustrate an exemplary surface cleaning device 200 in accordance with aspects of the present disclosure. The surface cleaning device 200 can be configured to remove debris by sweeping and by wet mopping in one step. As the user is moving the surface cleaning device 200 across the floor, the surface cleaning device 200 can be configured to first sweep the debris from the surface and then mop up any remaining debris from the floor. Rather than spraying liquid onto the surface in front of the device, the surface cleaning device 200 can dispense liquid directly onto a cleaning pad 248 to remove debris after larger debris has been removed by a sweeper assembly 210. For example, the surface cleaning device 200 can include a front portion that funnels large, dry debris from the surface into a sweeper assembly 210 to collect the debris into a debris container 246, and then liquid can be dispersed into the cleaning pad 248 behind a brush 250 to remove smaller debris from the surface.

In addition to the features of the surface cleaning device 100 illustrated and described in FIGS. 1-3, the surface cleaning device 200 can include additional components used in connection with a wet mop assembly. The wet mop assembly can include a fluid tank 216, one or more fluid lines, and a plurality of nozzles 222.

The surface cleaning device 200 can include a handle assembly 202 coupled to a cleaning head 206. The handle assembly 202 can include an elongated arm, such as a pole, having a tubular shape and extending between a top end and a bottom end. The elongated arm, or pole, can include a first segment at the top end and a second segment at the bottom end, and wherein the first segment is telescopingly received by the second segment. A handle 212 can be connected to the top end of the pole. A trigger 214 can be coupled to the handle assembly 202, such as the handle 212, and configured to release a fluid from the fluid tank 216. For example, when a user squeezes the trigger 214, the liquid gets pushed down into the cleaning head 206 and saturate the cleaning pad 248 and floor directly below the cleaning head 206. The surface cleaning device 200 can function as a self-saturating liquid system.

A cleaning head 206 can be coupled to the bottom end of the pole. A mounting mechanism can couple the cleaning head 206 to the bottom of the pole. The mounting mechanism can be a universal join allowing the elongated arm to pivot 360 degrees about the universal joint. The joint may be a thin universal joint positioned sideways. For example, one of the dimensions of the universal joint is thin. The join can attach the pole to the cleaning head 206 in a bridge-like configuration. The joint can be configured such that it minimally displaces any debris from the front of the cleaning head 206 to the back of the cleaning head 206.

The cleaning head 206 can include a base 240 having a top surface and a bottom surface, and a pair of tapered front portions, a rear portion, and a pair of side edges extending between the front and back portions. The cleaning head 206 can include a housing 236. The housing 236 can define an inlet opening 238 adjacent to the front edge of the base 240 of the cleaning head 206. The front portion of the base 240 can define a rectangular-shaped inlet notch in alignment with the inlet opening 238 of the housing 236. The cleaning head 206 can be formed in a bow-tie shape. The bow-tie shape of the cleaning head 206 can funnel dry debris into the sweeper head. For example, larger pieces of debris can funnel toward the front of the inlet notch and the sweeper head.

The cleaning head 206 can include a pair of tapered housing 236, such as a first and second tapered housing 266, 268, adjacent opposing sides of the housing 236. A switch 270 can be coupled to a first tapered housing 266. The switch 270 can be depressed, for example, by using a foot. A battery assembly 204 can be coupled to a second tapered housing 268. The cleaning head 206 can include one or more windows 272. The pair of adjacent tapered housing 266, 268 can include a pair of windows 272. The window 272 can be formed from transparent material or any other desired material. The window 272 can allow a user to view fluid disposed in the tapered front housing 266, 268. The window 272 can allow a user to view channels and holes build in the underside of the nozzle 222. The front portions of the base 240 can include a pair of guiding segments, such as flaps 244, tapering toward one another and the base 240. The flaps 244 can be located adjacent the inlet notch. The flaps 244 can be permanently coupled to the tapered housing 266, 268. The flaps 244 can be removably attached to edges of the tapered housing 268, 268. The flaps 244 can be flexible. The flaps 244 can be made of a flexible plastic, such as a flexible hard plastic.

A sweeper assembly 210 can be connected to the top surface of the cleaning head 206. For example, the sweeper assembly 210 can be connected to a top middle surface of the cleaning head 206. The sweeper assembly 210 can include a housing 236 having a front portion 226, a rear portion, a pair of lateral portions, an upper lid, and defining a debris container 246. The upper lid can be pivotably connected to the housing 236 to allow the housing 236 to be opened. The debris container 246 may not include an upper lid. The debris container 246 can be magnetically removable from the cleaning head 206, or removable by any other desired mechanism. The debris container 246 can be removed from a bottom portion of the cleaning head 206. The debris container 246 may be formed from plastic, wood, metal, a magnetic material, or any other desired material.

The sweeper assembly 210 can include a brush 250. The brush 250 can be positioned in a brush housing and extending between the pair of lateral sides along an axis in alignment with the inlet opening 238. The brush 250 can comprise a roller 252. The roller 252 can rotate about an axis. The brush 250 can comprise a plurality of bristles 254. The plurality of bristles 254 can extend radially outwardly from the roller 252 for sweeping debris the debris container 246 in response to rotation of the roller 252.

The motor assembly 208 can be positioned on the top surface of the base 240 adjacent to the back portion and one of the side portions of the base 240. A motor can be positioned in the motor assembly 208. The motor assembly 208 can have a motor, an output shaft, a first pulley, a second pulley, or any other desired component. The first pulley can be secured to the output shaft of the motor. The second pulley can be secured to the roller 252 in alignment with the first pulley. A belt can be disposed about the first and second pulleys for providing rotational movement of the roller 252 in response to rotation of the motor. The battery assembly 204 can be positioned on the top surface of the base 240 adjacent to the back portion and one of the lateral sides of the base 240. At least one battery can be positioned in the battery assembly 204 and electrically connected with the motor for providing power to the motor. The battery can include a rechargeable lithium ion battery, a NiMH battery, or any other desirable energy source. The switch 270, or power button, can be located on the battery assembly 204, the cleaning head 206, or any other desired location. The switch 270 can be electrically connected to the motor to allow a user to turn the motor on and off.

Figure 7A:
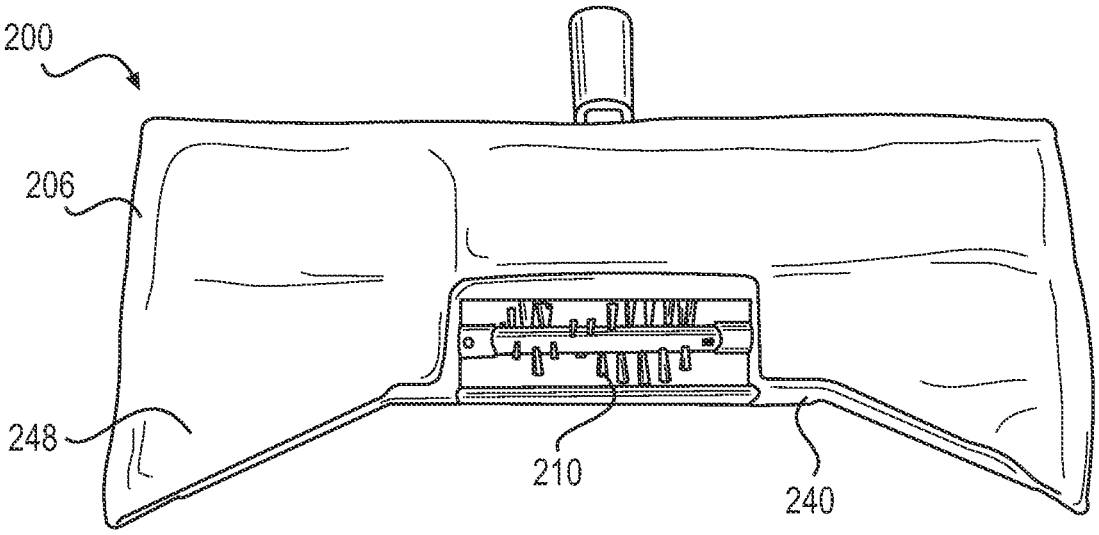
FIGS. 7A-7E are views the cleaning head and cleaning pad of the surface cleaning device in accordance with aspects of the present disclosure.
Figure 7B:
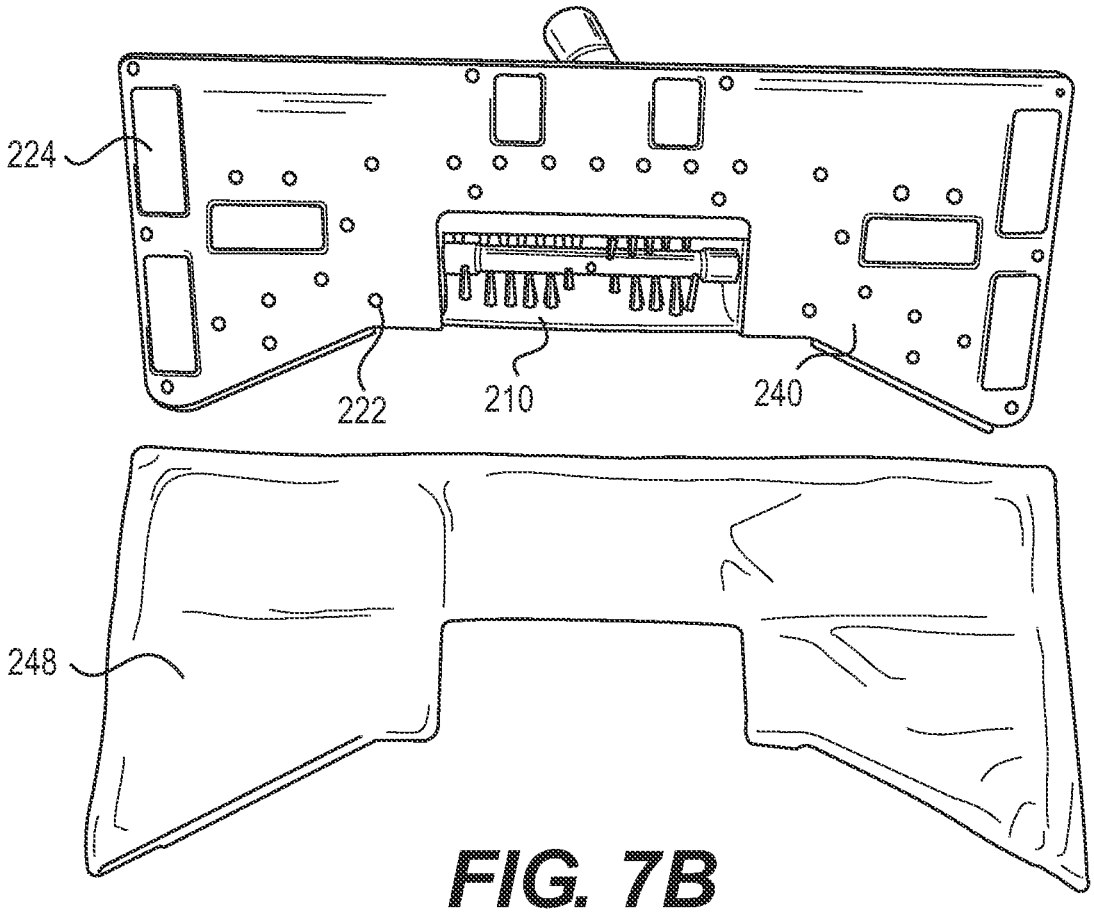
Figure 7C:
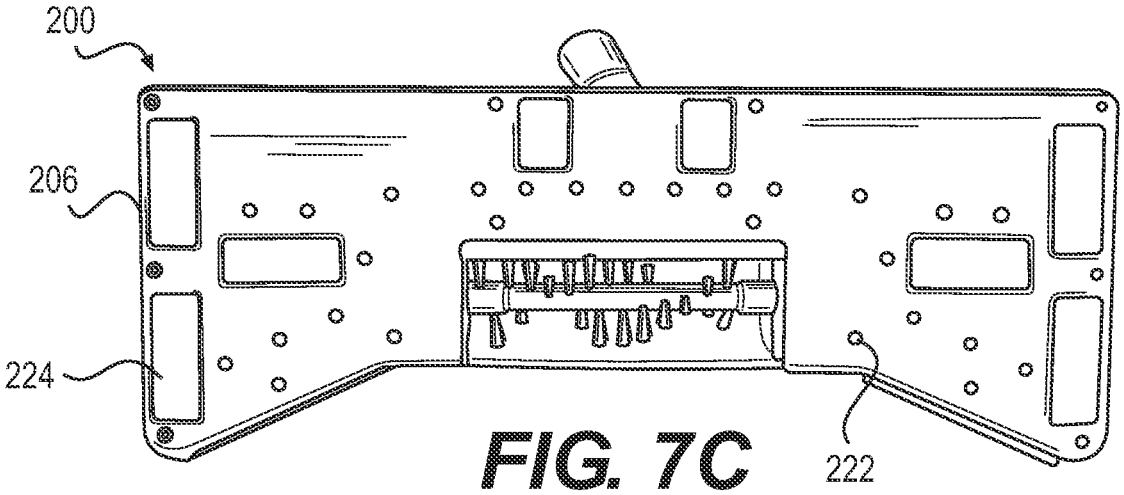

As illustrated in FIGS. 7A-7E, the cleaning pad 248 can be coupled to a bottom portion of the cleaning head 206 and configured to remove at least some of the debris from the surface. FIG. 7A illustrates the cleaning pad 248 fixed to portions of the cleaning head 206. For example, the cleaning head 206 can be fixed to the rear portion 230 and side portions 228 of the cleaning head 206. The cleaning pad 248 may be positioned to not go beyond the front portion of the cleaning head 206. The cleaning pad 248 can further be fixed to the bottom portion of the base 240. As illustrated in FIGS. 7A-C, the cleaning pad 248 can be coupled to the cleaning head 206 using an attachment strip 224, Velcro® strips, or any other desired attachment device coupled to the bottom portion of the base 240. For example, four, six, eight, or any other desired number of small attachment strips 224, one on each side or about the perimeter of the cleaning head 206 can be built into the cleaning head 206. The cleaning pad 248 can stick directly to the attachment strip, such as Velcro®.

Figure 7D:
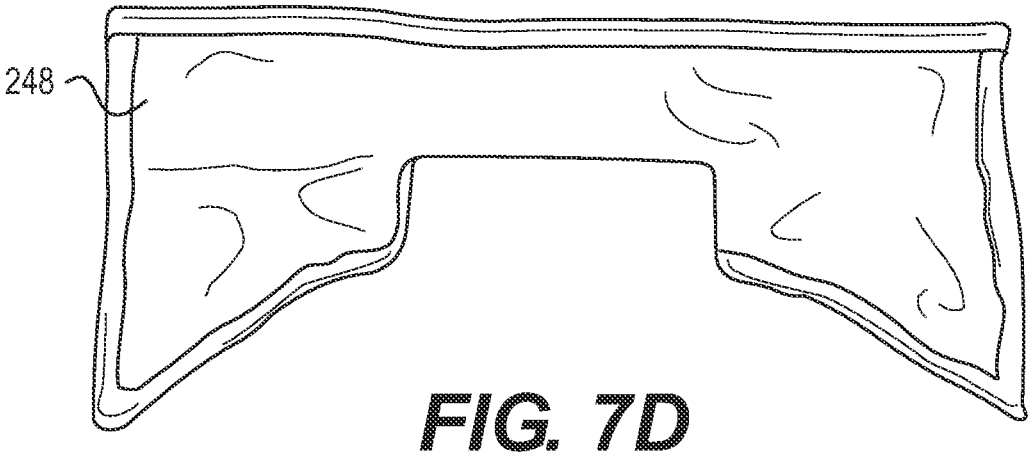
Figure 7E:
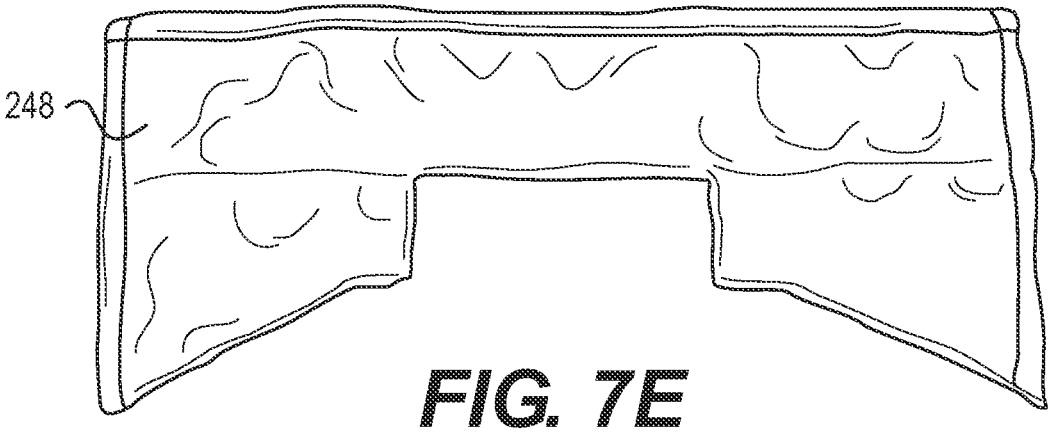
Figure 8:
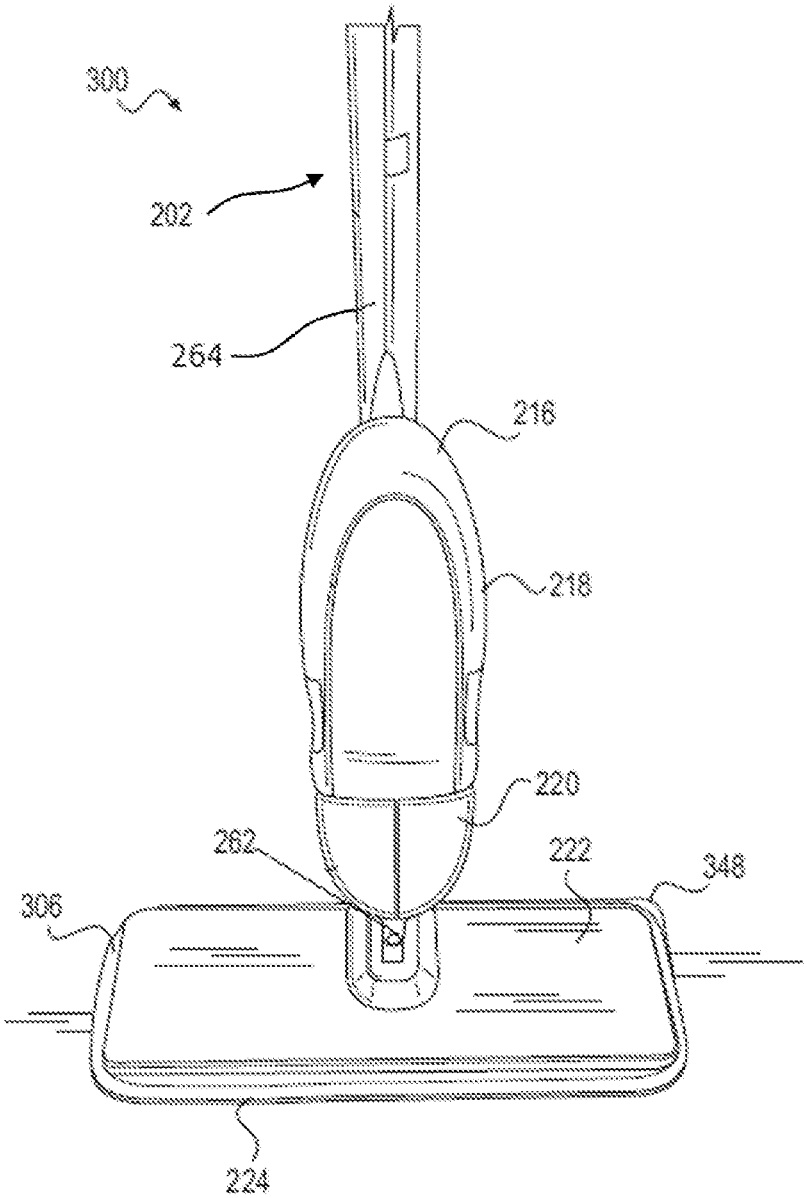
FIG. 8 is a front view of another embodiment of a surface cleaning device in accordance with aspects of the present disclosure.
Figure 9:
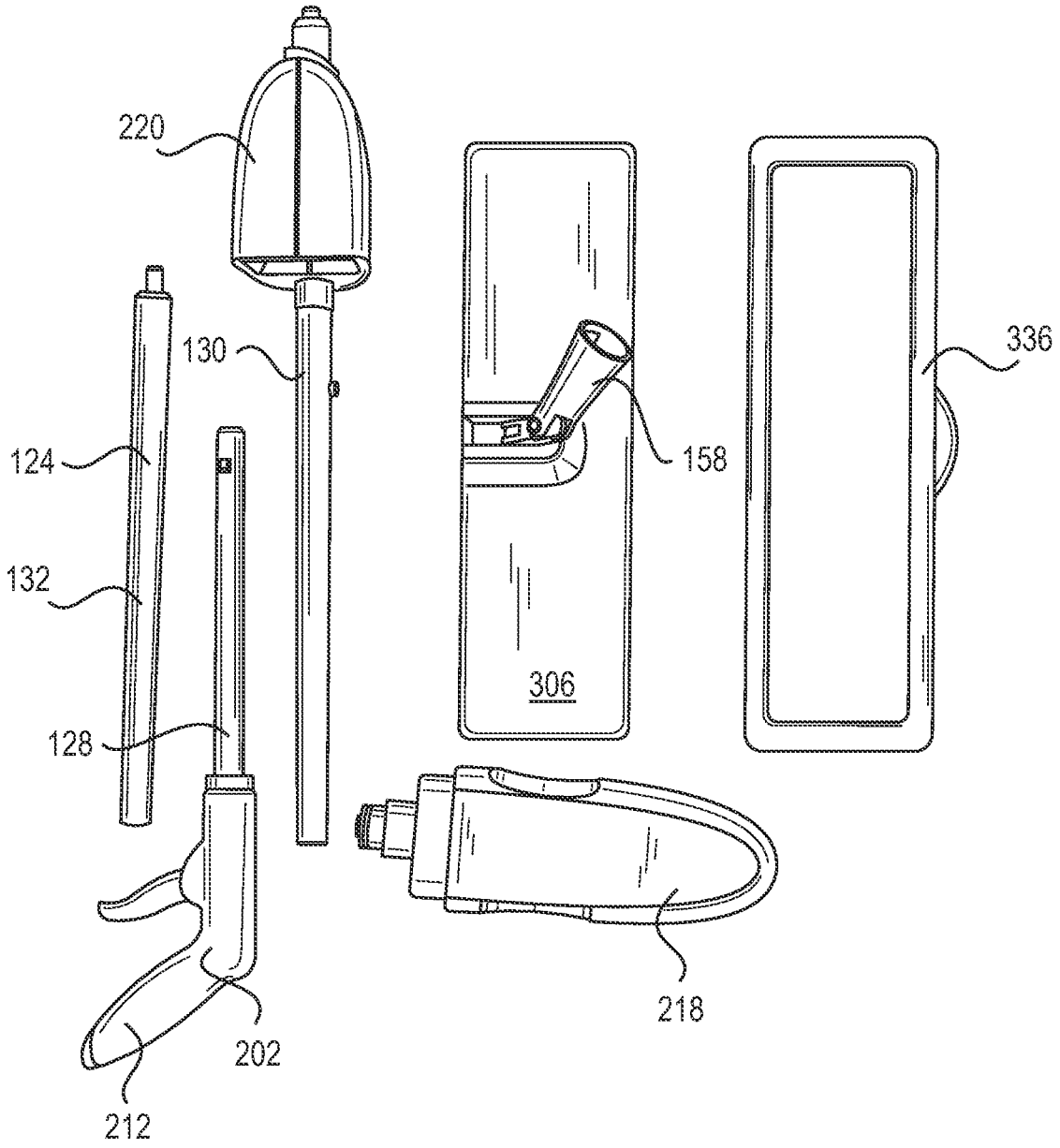
FIG. 9 is a perspective view of a handle of the surface cleaning device in accordance with aspects of the present disclosure.
Figure 10:
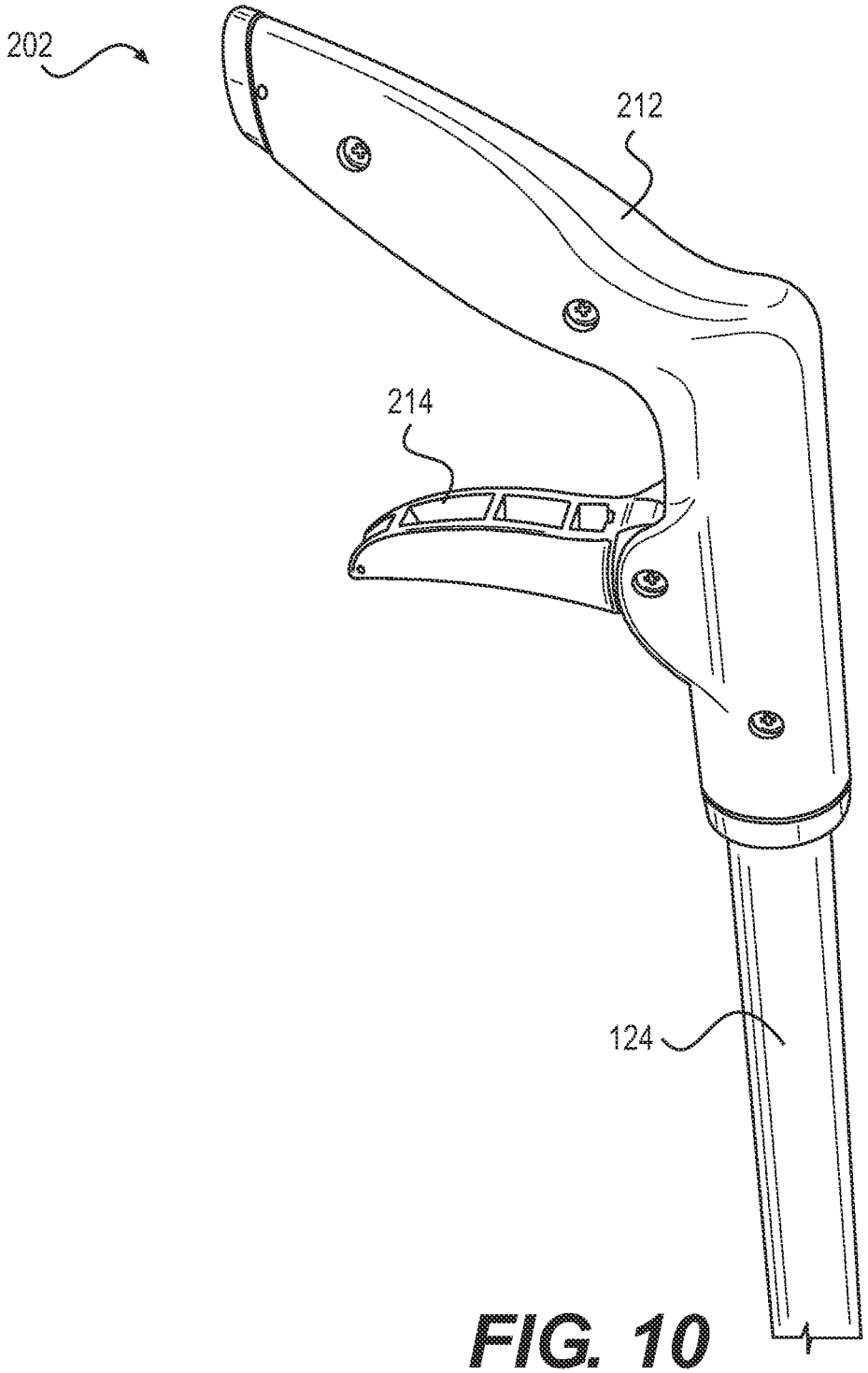
FIG. 10 is a side view of a handle assembly of the surface cleaning device in accordance with aspects of the present disclosure.
Figure 11:
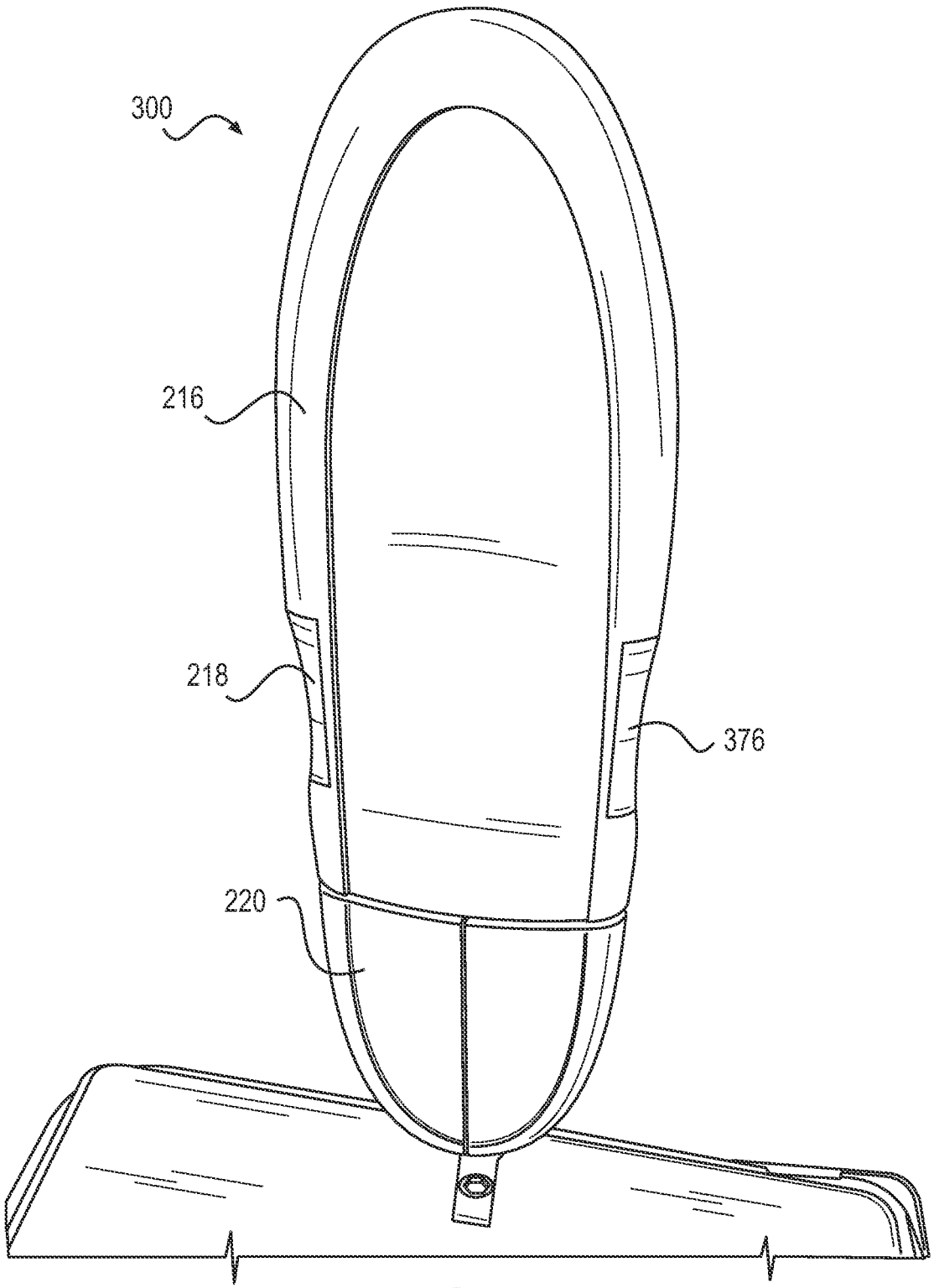
FIG. 11 is a front view of a water tank assembly of the surface cleaning device in accordance with aspects of the present disclosure.
Figure 12:
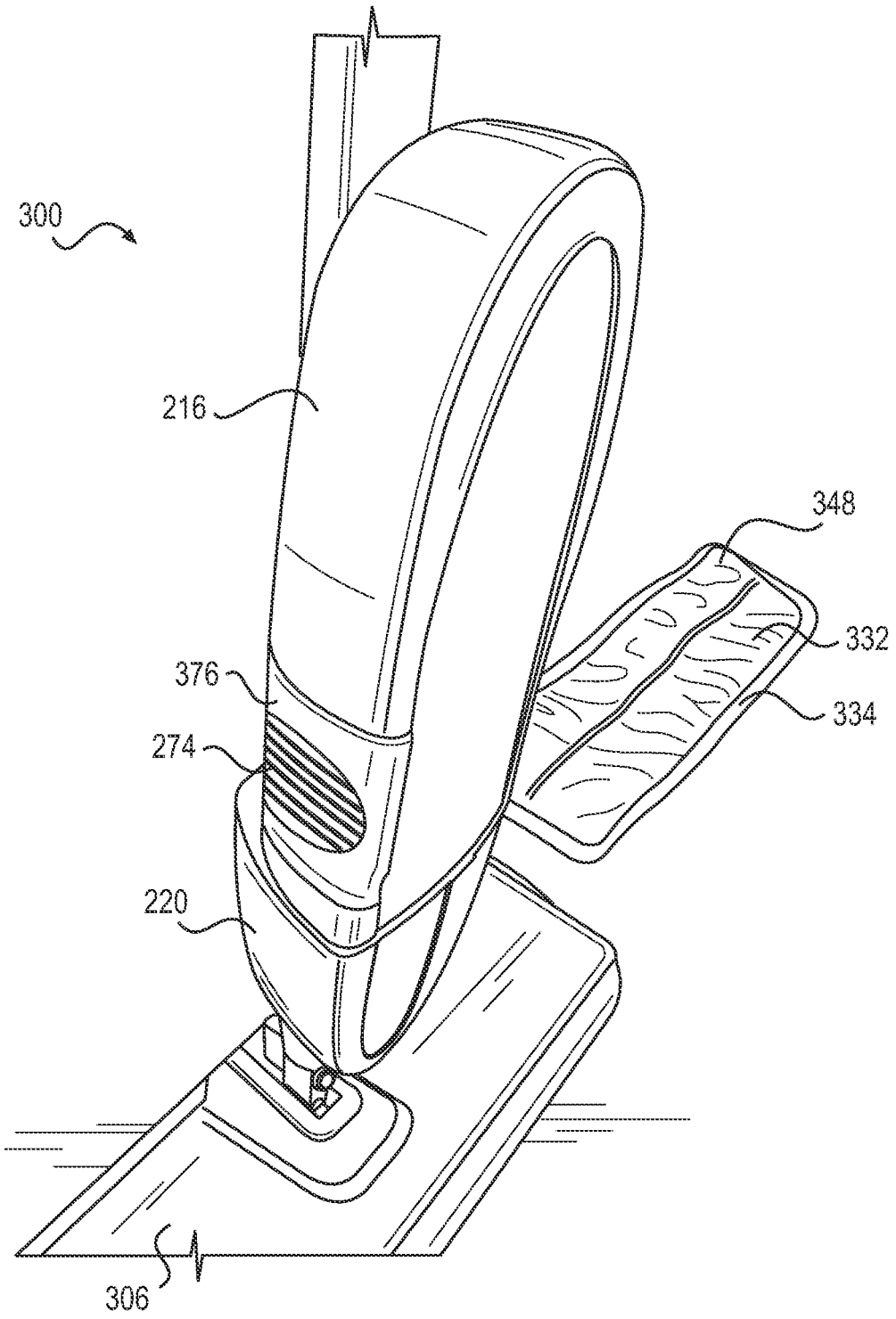
FIG. 12 is a perspective view of the water tank assembly of the surface cleaning device in accordance with aspects of the present disclosure.
Figure 13:
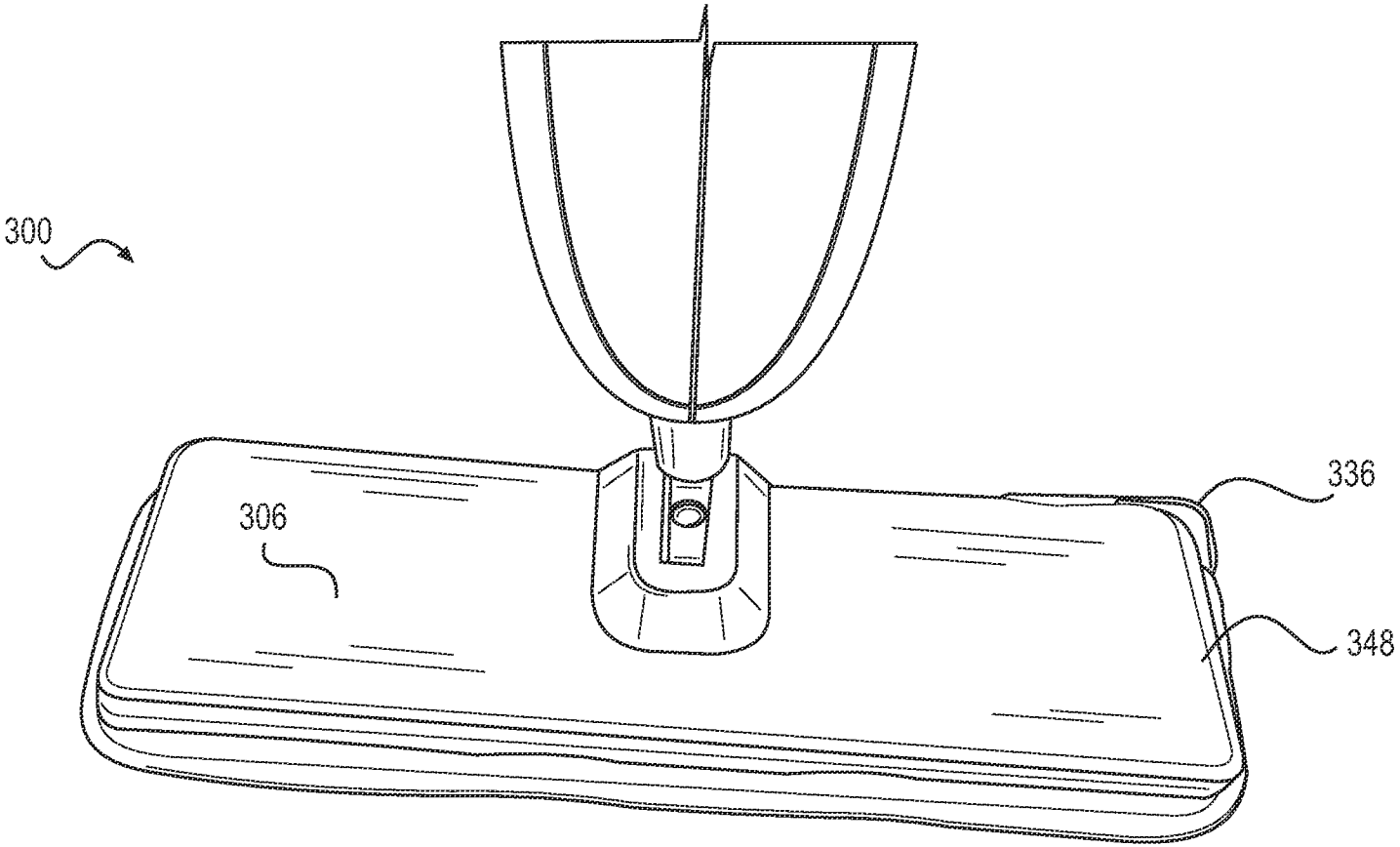
FIG. 13 is a top perspective view of a cleaning head of the surface cleaning device in accordance with aspects of the present disclosure.
Figure 14:
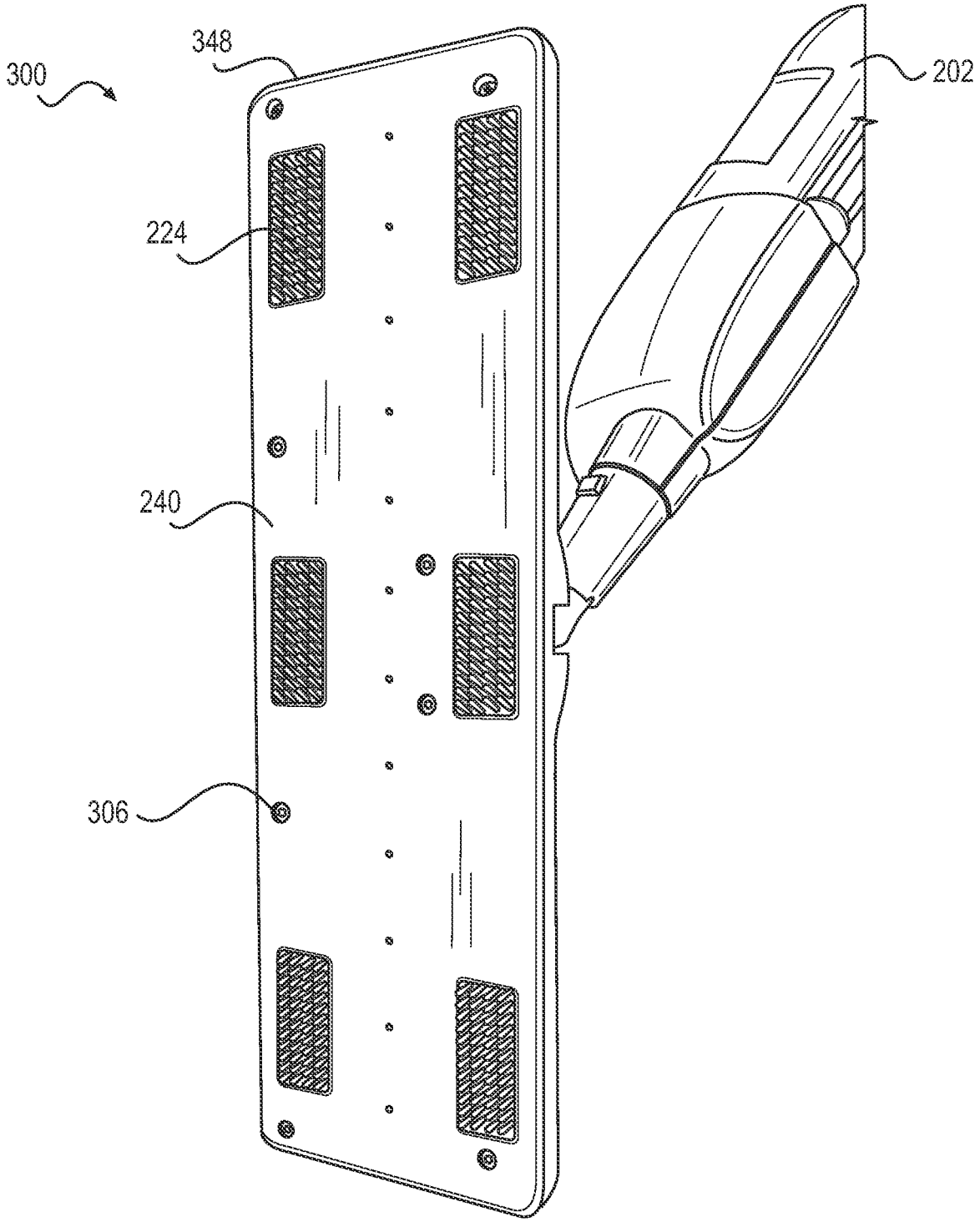
FIG. 14 is a bottom perspective view of the cleaning head of the surface cleaning device in accordance with aspects of the present disclosure.
Figure 15A:
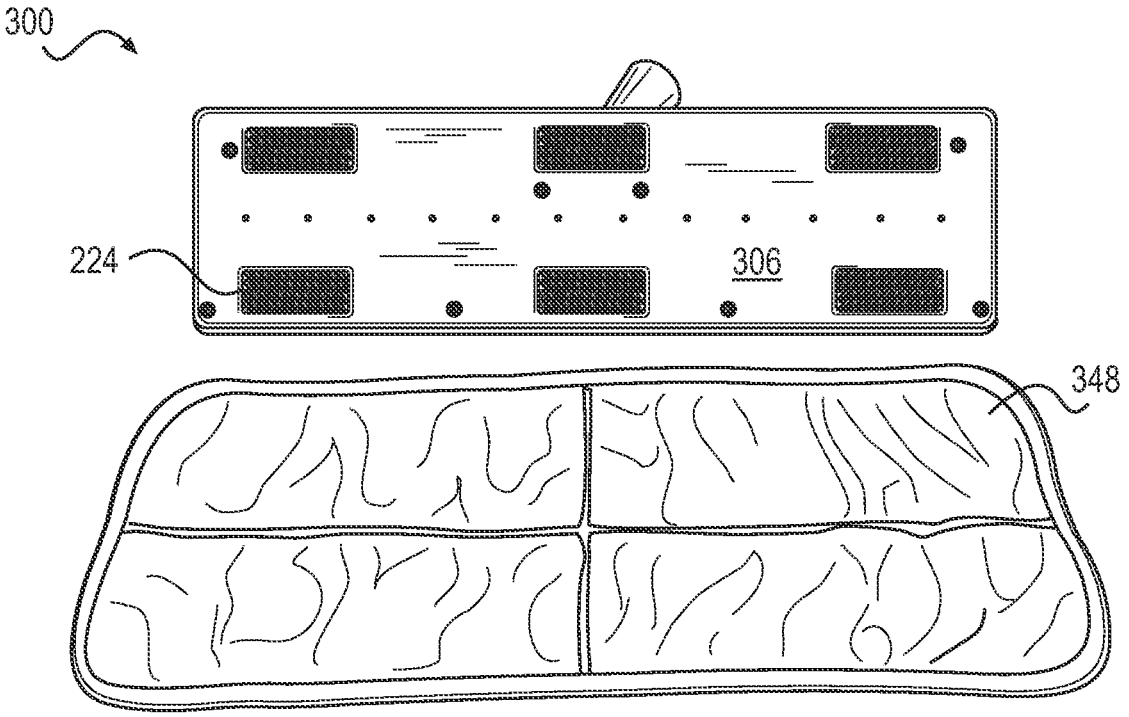
FIGS. 15A-15D are views the cleaning head and cleaning pad of the surface cleaning device in accordance with aspects of the present disclosure.
Figure 15B:
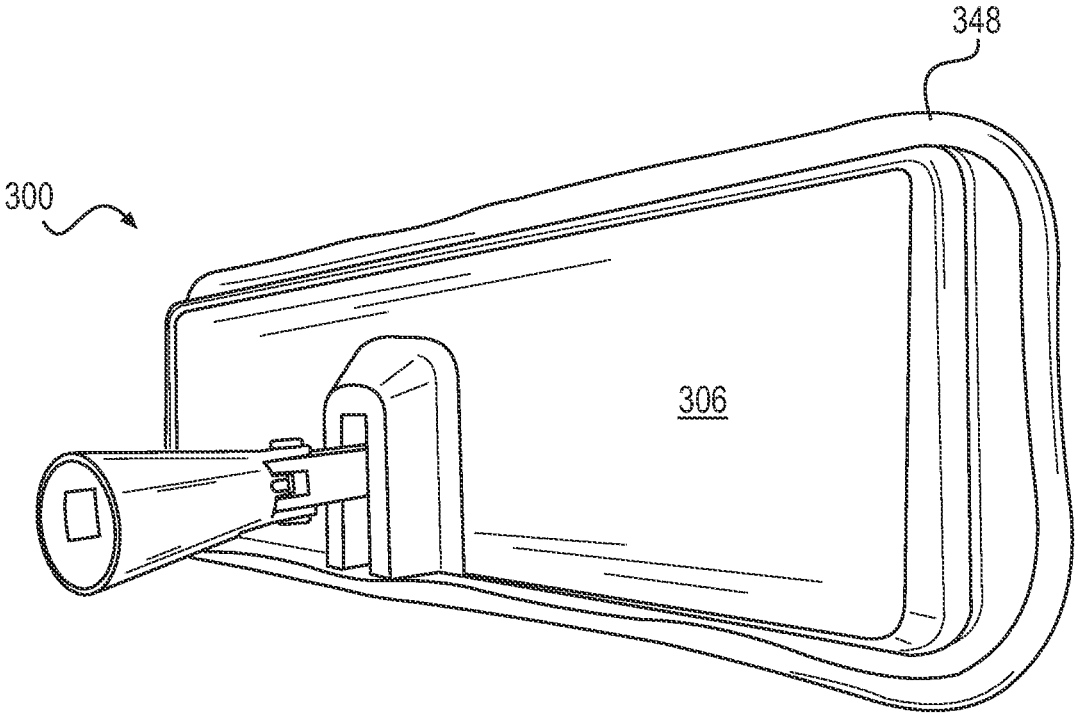
Figure 15C:
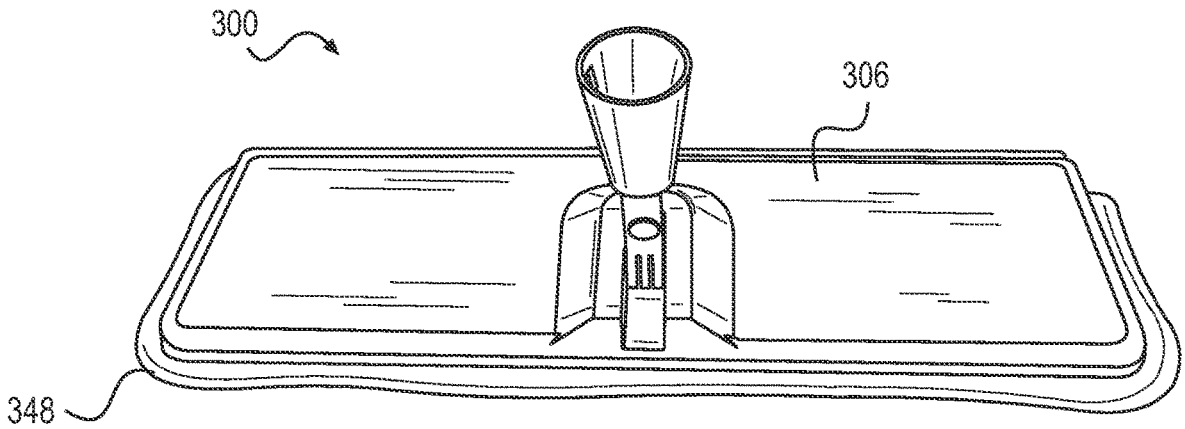
Figure 15D:
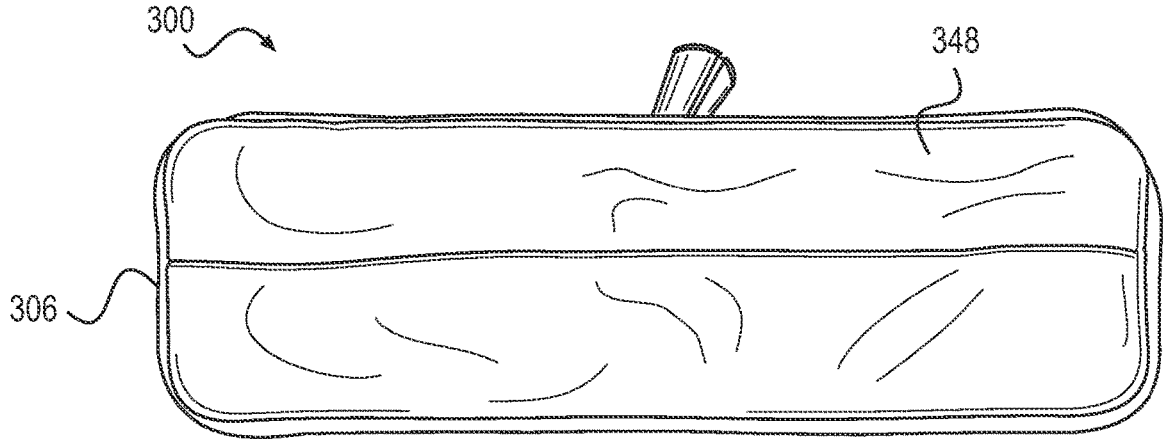
Figure 16A:
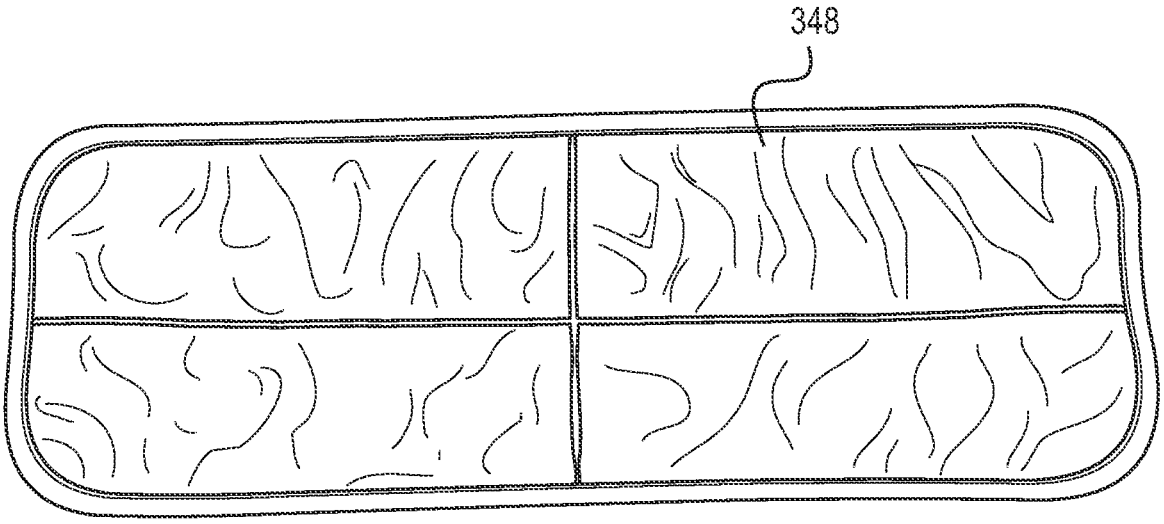
FIGS. 16A-16B are top and bottom views the cleaning pad of the surface cleaning device in accordance with aspects of the present disclosure.
Figure 16B:
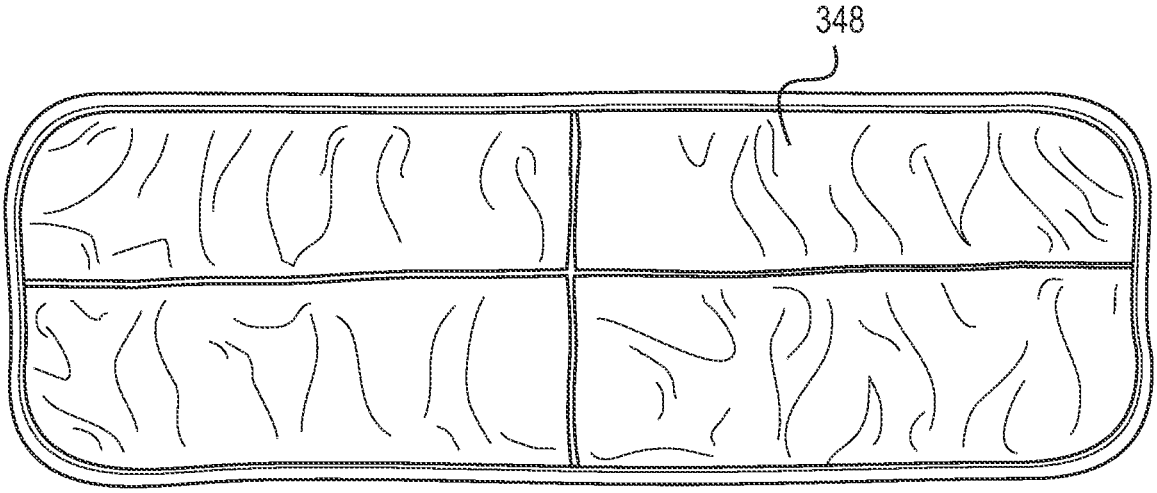

FIGS. 7D-E illustrate top and bottom sides of the cleaning pad 248. The cleaning pad 248 may be formed from one or more materials. The cleaning pad 248 can be a reusable pad, such as a microfiber pad or any other desired material. Such material can be used to remove small debris from the surface. The cleaning pad 248 may be formed from wicking material. For example, a first portion 232 of the cleaning pad 248 that couples to the rear portion 230 and the lateral side portions 228 of the cleaning head 206 can be formed from a wicking material to remove, or wick up moisture from the surface. Moisture may include water, liquid, or any other suitable condensation condensed on the surface. The first portion 232 of cleaning pad 248 can be configured as a finishing strip on the back of the cleaning head 206. The cleaning pad 248 may be formed from non-wicking material. For example, a second portion 234 of the cleaning pad 248 coupled to the bottom portion of the base 240 can be formed from a non-wicking material (e.g., binding material) to bind, collect, or remove debris from the surface. The cleaning pad 248 may be formed having one or more angled front portions. The cleaning pad 248 can be formed in generally a bow-tie shape or any other desired shape.

The fluid tank 216 can be files to the handle assembly 202, such as the pole, for receiving a liquid, such as a cleaning solution. The fluid tank 216 can be configured to store fluid and be in fluid communication with the cleaning head 206. A first fluid line 262 can extend from the fluid tank 216 to the plurality of nozzles 222. A second fluid line 264 can extend from the fluid tank 216 to the handle assembly 202. The fluid tank 216 may include one or more tanks. The fluid tank 216 may include one or more compartments. An upper tank compartment 218 can be configured to receive and store the fluid. A lower tank compartment 220 can be configured to receive the fluid from the upper tank compartment 218, for example, after the trigger 214 is activated. The trigger 214 can be moveable for providing a pressure increase in the second fluid line 264 to cause the liquid to pass from the fluid tank 216 into the nozzles 222. When the trigger 214 is activated, the fluid can be forced to travel through the first fluid line 262. The upper tank portion can include a lid, a removable portion, a screw top, or any other desired opening for the fluid tank 216 to receive liquid.

The surface cleaning device 200 can include a pump system 274. The pump system 274 can be coupled to the fluid tank 216. The pump system 274 can force the liquid down from the upper tank compartment 218 to the lower tank compartment 220. The pump system 274 can include a pump. The pump can force liquid to fill the lower tank compartment 220. The pump can push a rod, which can force air to force the liquid down the tank. The pump system 274 can include a valve. For example, when the trigger 214 is activated, the pump can release the valve to allow liquid to flow through the fluid tank 216 and the first fluid line 262.

As illustrated in FIGS. 7B-C, the plurality of nozzles 222, such as ports or outlets, can be distributed along base 240 adjacent to the cleaning pad 248 such that the fluid from the fluid tank 216 is configured to flow through the plurality of nozzles 222 onto the cleaning pad 248. The plurality of nozzles 222 can be connected to the top surface of the base 240 and each extending downwardly though the base 240 and into the cleaning pad 248 to dispense the fluid, such as cleaning solution, into the cleaning pad 248. The cleaning nozzles 222 distributed along the cleaning pad 248. For example, the plurality of nozzles 222 may include twelve nozzles distributed to inner and outer portions of the cleaning pad 248. The plurality of nozzles 222 may include twenty-four nozzles, or any other desired quantity of nozzles, distributed to inner and outer portions of the cleaning pad 248. The plurality of nozzles can be positioned toward the edges, or outer periphery of the cleaning pad 248, or any other desired locations. The plurality of nozzles 222 can be positioned about the cleaning pad 248 for even distribution of liquid on the cleaning pad 248.

A squeegee 242 can be coupled to the rear portion of the cleaning head 206. The squeegee 242 can be positioned behind the bristles 254 on the bottom portion of the cleaning head 206. The squeegee 242 can be located at the rear portion 230 of the cleaning head 206. The squeegee 242 can be configured to move moisture on the surface as the cleaning head 206 moves across the surface. For example, after the fluid saturates at least portions of the cleaning pad 248, the squeegee 242 can move moisture or fluid toward the back portion of the cleaning pad 248 to absorb any access moisture on the surface as the surface cleaning device moves across the surface. The squeegee 242 can reduce streaks across the surface. The squeegee 242 can be a thick strip or any other desired configuration. The squeegee 242 can be formed from rubber or any other desired material. The surface cleaning device 200 can allow a user to sweep and mop a surface in one step, such as one movement over a surface.

The surface cleaning device 200 can be configured to shoot debris to the back of the sweeper head. The debris container 246 may include think strips that funnel dry debris into the debris container 246. The cleaning pad 248 can remove small debris from the surface. Any debris under a certain size may dangle on the cleaning pad 248. The cleaning head 206 can include a barrier between the wet and dry areas of the surface. The surface cleaning device can contain the moisture.

In one exemplary embodiment, the surface cleaning device can include the cleaning head 206 having the housing 236 and the debris container 246 disposed within the housing 236. The cleaning pad 248 can be formed in generally a bow-tie shape. The tapered front portion 266 of the cleaning head 206 can be configured to funnel debris into the sweeper assembly 210. The flap 244 can be coupled to the cleaning head 206 and configured to direct debris toward the inlet opening 238 of the housing 236. The sweeper assembly 210 can be disposed within the housing 236 adjacent to the debris container 246 and configured to funnel the debris from the surface into the debris container 246. The brush 250 can be rotatably coupled to the sweeper assembly 210. The brush 250 can include a roller 252 having a plurality of bristles 254 extending outwardly from the roller 252. The brush 250 can be configured to sweep the debris into the debris container 246.

The surface cleaning device 200 can include the handle assembly 202 coupled to the cleaning head 206 and the trigger 214 coupled to the handle assembly 202 such that the trigger 214 is configured to release the fluid from the fluid tank 216. The fluid tank 216 can be configured to store fluid and be in fluid communication with the cleaning head 206. The first fluid line 262 can extend from the fluid tank 216 to the plurality of nozzles 222 and a second fluid line 264 can extend from the fluid tank 216 to the handle assembly 202. The upper tank compartment 218 can be configured to receive and store the fluid. The lower tank compartment 220 can be configured to receive the fluid from the upper tank compartment 218 after the trigger 214 is activated to force the fluid to travel through the first fluid line 262. The plurality of nozzles 222 can be distributed along the cleaning pad 248 such that the fluid from the fluid tank 216 is configured to flow through the plurality of nozzles 222 onto the cleaning pad 248. The cleaning pad 248 can be coupled to the cleaning head 206 and configured to remove at least some of the debris from the surface. The cleaning pad 248 can be formed in generally a bow-tie shape. The cleaning pad 248 can fit over side and rear portions of the cleaning head 206. The front portion 256 of the cleaning pad 248 can be formed from a non-wicking material. The rear and side portions 258, 260 of the cleaning pad 248 can be formed from wicking material to collect moisture from the surface.

The squeegee 242 can be coupled to the rear portion 230 of the cleaning head 206 and configured to move moisture on the surface as the cleaning head 206 moves across the surface. For example, after the fluid saturates at least portions of the cleaning pad 248, the squeegee 242 can move moisture or fluid toward the back portion of the cleaning pad 248 to absorb any access moisture on the surface as the surface cleaning device 200 moves across the surface. The surface cleaning device 200 can allow a user to sweep and mop a surface in one step (i.e., in one movement across a surface).

The surface cleaning device can include additional and/or fewer components and is not limited to those illustrated in FIGS. 4-7.

FIGS. 8-16 illustrate an exemplary surface cleaning device 300 in accordance with aspects of the present disclosure. The surface cleaning device 300 can include the handle assembly 202, fluid tank 216, and pump system 274 274 similar to that shown in FIGS. 4-7. The surface cleaning device 300 can be configured as a cleaning device without the sweeper assembly 210.

The surface cleaning device 300 the surface cleaning device can include the cleaning head 306. The cleaning head 306 can be a rectangular, bow-tie, or any other desired shape. A housing 336 can be coupled to the cleaning head 306. The housing 336 can be clipped onto the cleaning head 306 or attached by any other desired fastener. The surface cleaning device 300 can include the handle assembly 202 coupled to the cleaning head 306 and the fluid tank 216. The fluid tank 216 can be configured to store fluid 376 and be in fluid communication with the cleaning head 306. The cleaning pad 348 can be coupled to the cleaning head 306, such as by using an attachment strip 224, such as Velcro®, and configured to remove the debris from the surface. The plurality of nozzles 222 distributed along the cleaning pad 348, wherein the fluid 376 from the fluid tank 216 is configured to flow through the plurality of nozzles 222 onto the cleaning pad 348. The first fluid line 262 can extend from the fluid tank to the plurality of nozzles 222. The second fluid line 264 can extend from the fluid tank 216 to the handle assembly 202. The trigger 214 can be coupled to the handle assembly 202. The upper tank compartment 218 can be configured to receive and store the fluid 376. The lower tank compartment 220 can be configured to receive fluid 376 after the trigger is activated and force the fluid 376 to travel through the first fluid line 262 to the plurality of nozzles 222 to saturate the cleaning pad 348.

The cleaning pad 348 can be formed from one or more materials. The cleaning pad 348 can be formed from both wicking and non-wicking material. For example, a first portion 332, such as a middle portion, can be formed of non-wicking material and a second portion 334, such as the edges, can be formed of wicking material. The saturated cleaning pad 348 can be used to remove debris, such as small particle debris, from the surface. The cleaning pad 348 can also be used to soak up any access fluid on the surface. A dry cleaning pad 348 can also be used to remove debris from the surface.

The surface cleaning device can include additional and/or fewer components and is not limited to those illustrated in FIGS. 8-16.

Consistent with the above disclosure, the examples of systems and methods enumerated in the following clauses are specifically contemplated and are intended as a non-limiting set of examples.

Clause 1. A surface cleaning device, comprising:

a cleaning head having a housing;

a fluid tank configured to store fluid and be in fluid communication with the cleaning head;

a cleaning pad coupled to the cleaning head and configured to remove debris from a surface; and a plurality of nozzles distributed along the cleaning pad, wherein the fluid tank is configured to release at least some of the fluid such that the released fluid flows through the plurality of nozzles onto the cleaning pad.

Clause 2. The surface cleaning device of any preceding clause, further comprising:

a debris container disposed within the housing; and a sweeper assembly disposed within the housing adjacent to the debris container and configured to funnel at least some of the debris from the surface into the debris container.

Clause 3. The surface cleaning device of any preceding clause, further comprising:

a brush rotatably coupled to the sweeper assembly and configured to sweep at least some of the debris into the debris container, wherein the brush comprises a roller having a plurality of bristles extending outwardly from the roller.

Clause 4. The surface cleaning device of any preceding clause, wherein the debris container is configured to magnetically couple to the cleaning head.

Clause 5. The surface cleaning device of any preceding clause, further comprising:

a handle assembly coupled to the cleaning head; and a trigger coupled to the handle assembly, wherein the trigger is configured to release the fluid from the fluid tank.

Clause 6. The surface cleaning device of any preceding clause, wherein the fluid tank further comprises:

an upper tank compartment configured to receive and store the fluid; and a lower tank compartment configured to receive the fluid from the upper tank compartment after the trigger is activated and force the fluid to travel through the first fluid line.

Clause 7. The surface cleaning device of any preceding clause, further comprising:

a handle assembly coupled to the cleaning head;

a first fluid line extending from the fluid tank to the plurality of nozzles; and a second fluid line extending from the fluid tank to the handle assembly.

Clause 8. The surface cleaning device of any preceding clause, wherein a first portion of the cleaning pad is formed from a non-wicking material; and wherein a second portion of the cleaning pad is formed from a wicking material and configured to collect moisture from the surface.

Clause 9. The surface cleaning device of any preceding clause, wherein the cleaning head is a bow-tie shape; and wherein the cleaning pad is the bow-tie shape and configured to couple to side and rear portions of the cleaning head.

Clause 10. The surface cleaning device of any preceding clause, further comprising:

an attachment strip coupled to the cleaning head and configured to removably attach the cleaning pad to the cleaning head.

Clause 11. The surface cleaning device of any preceding clause, wherein a front portion of the housing defines an inlet opening.

Clause 12. The surface cleaning device of any preceding clause, further comprising:

a base coupled to the cleaning head and comprising a pair of tapered front portions; and a pair of flaps coupled to the pair of tapered front portions and configured to direct at least some of the debris toward the inlet opening.

Clause 13. The surface cleaning device of any preceding clause, further comprising:

a squeegee coupled to a rear portion of the cleaning head, wherein the squeegee is configured to move moisture on the surface as the cleaning head moves across the surface.

Clause 14. A surface cleaning device, comprising:

a cleaning head;

a fluid tank configured to store fluid and be in fluid communication with the cleaning head;

a cleaning pad coupled to the cleaning head and configured to remove debris from a surface, wherein the cleaning pad is formed from wicking material and non-wicking materials; and a plurality of nozzles distributed along the cleaning pad, wherein the fluid tank is configured to release at least some of the fluid such that the released fluid flows through the plurality of nozzles onto the cleaning pad.

Clause 15. The surface cleaning device of any preceding clause, further comprising:

a handle assembly coupled to the cleaning head and the fluid tank;

a first fluid line extending from the fluid tank to the plurality of nozzles; and a second fluid line extending from the fluid tank to the handle assembly.

Clause 16. The surface cleaning device of any preceding clause, wherein the fluid tank further comprises:

a trigger coupled to the handle assembly;

an upper tank compartment configured to receive and store the fluid; and a lower tank compartment configured to receive at least some of the fluid from the upper tank compartment after the trigger is activated and force the fluid to travel through the first fluid line.

Clause 17. The surface cleaning device of any preceding clause, further comprising:

an attachment strip coupled to the cleaning head and configured to removably attach the cleaning pad to the cleaning head.

Clause 18. A surface cleaning device, comprising:

a cleaning head coupled to a housing, wherein the housing defines an inlet opening;

a base coupled to the cleaning head and comprising a pair of tapered front portions;

a pair of flaps coupled to the pair of tapered front portions and configured to direct debris toward the inlet opening;

a debris container disposed within the housing;

a sweeper assembly disposed within the housing adjacent to the debris container and configured to sweep at least some of the debris from a surface into the debris container;

a cleaning pad coupled to the base and configured to remove at least some of the debris from the surface;

a fluid tank configured to store fluid and be in fluid communication with the cleaning head; and a plurality of nozzles distributed along the cleaning pad, wherein the fluid tank is configured to release at least some of the fluid such that the released fluid flows through the plurality of nozzles onto the cleaning pad.

Clause 19. The surface cleaning device of any preceding clause, further comprising:

a roller rotatably coupled to the sweeper assembly, and a plurality of bristles extending outwardly from the roller, wherein the roller is configured to sweep at least some of the debris into the debris container.

Clause 20. The surface cleaning device of any preceding clause, wherein the pair of flaps are permanently attached to the base; and wherein the pair of flaps are formed from flexible material.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A surface cleaning device, comprising:

a cleaning head having a housing, wherein a portion of the housing defines at least one inlet opening;

a fluid tank configured to store fluid and be in fluid communication with the cleaning head;

a cleaning pad coupled to the cleaning head and configured to remove debris from a surface;

a plurality of nozzles distributed along the cleaning pad, wherein at least some of the fluid stored in the fluid tank is released through the plurality of nozzles onto the cleaning pad;

a base coupled to the cleaning head and comprising a pair of tapered front portions; and a pair of flaps coupled to the pair of tapered front portions and configured to direct at least some of the debris toward the at least one inlet opening.

2. The surface cleaning device of claim 1, further comprising:

a debris container disposed within the housing; and a sweeper assembly disposed within the housing adjacent to the debris container and configured to funnel at least some of the debris from the surface into the debris container.

3. The surface cleaning device of claim 2, further comprising:

a brush rotatably coupled to the sweeper assembly and configured to sweep at least some of the debris into the debris container, wherein the brush comprises a roller having a plurality of bristles extending outwardly from the roller.

4. The surface cleaning device of claim 2, wherein the debris container is configured to magnetically couple to the cleaning head.

5. The surface cleaning device of claim 1, further comprising:

a handle assembly coupled to the cleaning head; and a trigger coupled to the handle assembly, wherein the trigger is configured to release the fluid from the fluid tank.

6. The surface cleaning device of claim 5, wherein the fluid tank further comprises:

an upper tank compartment configured to receive and store the fluid; and a lower tank compartment configured to receive the fluid from the upper tank compartment after the trigger is activated and force the fluid to travel through a first fluid line.

7. The surface cleaning device of claim 1, further comprising:

a handle assembly coupled to the cleaning head;

a first fluid line extending from the fluid tank to the plurality of nozzles; and a second fluid line extending from the fluid tank to the handle assembly.

8. The surface cleaning device of claim 1, wherein a first portion of the cleaning pad is formed from a non-wicking material; and wherein a second portion of the cleaning pad is formed from a wicking material and configured to collect moisture from the surface.

9. The surface cleaning device of claim 1, wherein the cleaning head is a bow-tie shape;

and wherein the cleaning pad is the bow-tie shape and configured to couple to side and rear portions of the cleaning head.

10. The surface cleaning device of claim 1, further comprising:

an attachment strip coupled to the cleaning head and configured to removably attach the cleaning pad to the cleaning head.

11. The surface cleaning device of claim 1, wherein a front portion of the housing defines the at least one inlet opening.

12. The surface cleaning device of claim 1, further comprising:

a squeegee coupled to a rear portion of the cleaning head, wherein the squeegee is configured to move moisture on the surface as the cleaning head moves across the surface.

13. A surface cleaning device, comprising:

a cleaning head having at least one inlet opening;

a fluid tank configured to store fluid and be in fluid communication with the cleaning head;

a cleaning pad coupled to the cleaning head and configured to remove debris from a surface, wherein the cleaning pad is formed from wicking material and non-wicking materials;

a plurality of nozzles distributed along the cleaning pad, wherein at least some of the fluid stored in the fluid tank is released through the plurality of nozzles onto the cleaning pad;

a base coupled to the cleaning head and comprising a pair of tapered front portions; and a pair of flaps coupled to the pair of tapered front portions and configured to direct at least some of the debris toward the at least one inlet opening.

14. The surface cleaning device of claim 13, further comprising:

a handle assembly coupled to the cleaning head and the fluid tank;

a first fluid line extending from the fluid tank to the plurality of nozzles; and a second fluid line extending from the fluid tank to the handle assembly.

15. The surface cleaning device of claim 14, wherein the fluid tank further comprises:

a trigger coupled to the handle assembly;

an upper tank compartment configured to receive and store the fluid; and a lower tank compartment configured to receive at least some of the fluid from the upper tank compartment after the trigger is activated and force the fluid to travel through the first fluid line.

16. The surface cleaning device of claim 13, further comprising:

an attachment strip coupled to the cleaning head and configured to removably attach the cleaning pad to the cleaning head.

17. A surface cleaning device, comprising:

a cleaning head coupled to a housing, wherein the housing defines an inlet opening;

a base coupled to the cleaning head and comprising a pair of tapered front portions;

a pair of flaps coupled to the pair of tapered front portions and configured to direct debris toward the inlet opening;

a debris container disposed within the housing;

a sweeper assembly disposed within the housing adjacent to the debris container and configured to sweep at least some of the debris from a surface into the debris container;

a cleaning pad coupled to the base and configured to remove at least some of the debris from the surface;

a fluid tank configured to store fluid and be in fluid communication with the cleaning head; and a plurality of nozzles distributed along the cleaning pad, wherein at least some of the fluid stored in the fluid tank is released through the plurality of nozzles onto the cleaning pad.

18. The surface cleaning device of claim 17, further comprising:

a roller rotatably coupled to the sweeper assembly, and a plurality of bristles extending outwardly from the roller, wherein the roller is configured to sweep at least some of the debris into the debris container.

19. The surface cleaning device of claim 17, wherein the pair of flaps are permanently attached to the base; and wherein the pair of flaps are formed from flexible material.

* * * * *